US007546240B2

(12) United States Patent
Mehrotra et al.

(10) Patent No.: US 7,546,240 B2
(45) Date of Patent: Jun. 9, 2009

(54) CODING WITH IMPROVED TIME RESOLUTION FOR SELECTED SEGMENTS VIA ADAPTIVE BLOCK TRANSFORMATION OF A GROUP OF SAMPLES FROM A SUBBAND DECOMPOSITION

(75) Inventors: Sanjeev Mehrotra, Kirkland, WA (US); Wei-Ge Chen, Sammamish, WA (US); Henrique Sarmento Malvar, Sammamish, WA (US)

(73) Assignee: Microsoft Corporation, Redmond, WA (US)

( * ) Notice: Subject to any disclaimer, the term of this patent is extended or adjusted under 35 U.S.C. 154(b) by 629 days.

(21) Appl. No.: 11/183,271

(22) Filed: Jul. 15, 2005

(65) Prior Publication Data

US 2007/0016405 A1 Jan. 18, 2007

(51) Int. Cl.
*G10L 19/00* (2006.01)

(52) U.S. Cl. ..... 704/230; 704/203; 704/226

(58) Field of Classification Search ..... 704/203, 704/204, 205, 226, 230, 254, 258, 500, 501, 704/503, E19.011, E19.012, E19.014, E19.02
See application file for complete search history.

(56) References Cited

U.S. PATENT DOCUMENTS 5,268,685 A * 12/1993 Fujiwara ..... 341/76
5,319,724 A 6/1994 Blonstein et al.
5,325,215 A 6/1994 Shibata et al.
5,357,594 A 10/1994 Fielder
5,379,351 A 1/1995 Fandrianto et al.
5,394,473 A 2/1995 Davidson
5,590,066 A 12/1996 Ohki
5,686,964 A 11/1997 Tabatabai et al.
5,845,243 A 12/1998 Smart et al.
5,848,391 A 12/1998 Bosi et al.
5,886,276 A 3/1999 Levine et al.
5,970,173 A 10/1999 Lee et al.

(Continued)

FOREIGN PATENT DOCUMENTS

CA 2452343 1/2003

(Continued)

OTHER PUBLICATIONS

Ravier, P. , Using malvar wavelets for transient detection, Jun. 1996, IEEE, 229-232.*

(Continued)

*Primary Examiner*—Daniel D Abebe
(74) *Attorney, Agent, or Firm*—Klarquist Sparkman, LLP

(57) ABSTRACT

A transform coder is described that performs a time-split transform in addition to a discrete cosine type transform. A time-split transform is selectively performed based on characteristics of media data. Transient detection identifies a changing signal characteristic, such as a transient in media data. After encoding an input signal from a time domain to a transform domain, a time-splitting transformer selectively perform an orthogonal sum-difference transform on adjacent coefficients indicated by a changing signal characteristic location. The orthogonal sum-difference transform on adjacent coefficients results in transforming a vector of coefficients in the transform domain as if they were multiplied by an identity matrix including at least one 2×2 time-split block along a diagonal of the matrix. A decoder performs an inverse of the described transforms.

20 Claims, 12 Drawing Sheets

U.S. PATENT DOCUMENTS

| | | | | |
|---|---|---|---|---|
| 5,995,151 | A | 11/1999 | Naveen et al. | |
| 5,995,539 | A | 11/1999 | Miller | |
| 6,029,126 | A | 2/2000 | Malvar | |
| 6,073,153 | A | 6/2000 | Malvar | |
| 6,115,689 | A | 9/2000 | Malvar | |
| 6,154,762 | A | 11/2000 | Malvar | |
| 6,167,093 | A | 12/2000 | Tsutsui et al. | |
| 6,226,616 | B1 | 5/2001 | You et al. | |
| 6,301,304 | B1 | 10/2001 | Jing et al. | |
| 6,311,154 | B1 | 10/2001 | Gersho et al. | |
| 6,324,560 | B1 | 11/2001 | Malvar | |
| 6,363,117 | B1 | 3/2002 | Kok | |
| 6,370,502 | B1 | 4/2002 | Wu et al. | |
| 6,473,534 | B1 | 10/2002 | Merhav et al. | |
| 6,487,574 | B1 | 11/2002 | Malvar | |
| 6,496,795 | B1 * | 12/2002 | Malvar | 704/203 |
| 6,507,614 | B1 | 1/2003 | Li | |
| 6,636,830 | B1 * | 10/2003 | Princen et al. | 704/204 |
| 6,687,726 | B1 | 2/2004 | Schneider | |
| 6,694,342 | B1 | 2/2004 | Mou | |
| 6,701,019 | B1 | 3/2004 | Wu et al. | |
| 6,728,317 | B1 | 4/2004 | Demos | |
| 6,735,567 | B2 | 5/2004 | Gao et al. | |
| 6,882,685 | B2 | 4/2005 | Malvar | |
| 7,043,423 | B2 | 5/2006 | Vinton et al. | |
| 7,062,445 | B2 | 6/2006 | Kadatch | |
| 7,310,598 | B1 * | 12/2007 | Mikhael et al. | 704/230 |
| 7,325,023 | B2 * | 1/2008 | Youn | 708/402 |
| 2002/0116199 | A1 * | 8/2002 | Wu et al. | 704/500 |
| 2003/0103679 | A1 * | 6/2003 | Etoh et al. | 382/250 |
| 2003/0115041 | A1 | 6/2003 | Chen et al. | |
| 2003/0115042 | A1 | 6/2003 | Chen et al. | |
| 2003/0115050 | A1 | 6/2003 | Chen et al. | |
| 2003/0115051 | A1 | 6/2003 | Chen et al. | |
| 2003/0115052 | A1 * | 6/2003 | Chen et al. | 704/230 |
| 2003/0233236 | A1 | 12/2003 | Davidson et al. | |
| 2004/0133423 | A1 | 7/2004 | Crockett | |
| 2004/0165737 | A1 | 8/2004 | Monro | |
| 2006/0004566 | A1 | 1/2006 | Oh et al. | |
| 2006/0025991 | A1 | 2/2006 | Kim | |
| 2006/0106597 | A1 | 5/2006 | Stein | |

FOREIGN PATENT DOCUMENTS

| | | | |
|---|---|---|---|
| DE | 4133460 | A1 | 4/1993 |
| EP | 854653 | | 7/1998 |
| JP | 2003-348598 | | 12/2003 |

OTHER PUBLICATIONS

Beerends, "Audio Quality Determination Based on Perceptual Measurement Techniques," Applications of Digital Signal Processing to Audio and Acoustics, Chapter 1, Ed. Mark Kahrs, Karlheinz Brandenburg, Kluwer Acad. Publ., pp. 1-38 (1998).

Caetano et al., "Rate Control Strategy for Embedded Wavelet Video Coders," Electronics Letters, pp. 1815-1817 (Oct. 14, 1999).

De Luca, "AN1090 Application Note: STA013 MPEG 2.5 Layer III Source Decoder," STMicroelectronics, 17 pp. (1999).

de Queiroz et al., "Time-Varying Lapped Transforms and Wavelet Packets," IEEE Transactions on Signal Processing, vol. 41, pp. 3293-3305 (1993).

Dolby Laboratories, "AAC Technology," 4 pp. [Downloaded from the web site aac-audio.com on World Wide Web on Nov. 21, 2001.].

Fraunhofer-Gesellschaft, "MPEG Audio Layer-3," 4 pp. [Downloaded from the World Wide Web on Oct. 24, 2001.].

Fraunhofer-Gesellschaft, "MPEG-2 AAC," 3 pp. [Downloaded from the World Wide Web on Oct. 24, 2001.].

Gibson et al., Digital Compression for Multimedia, Title Page, Contents, "Chapter 7: Frequency Domain Coding," Morgan Kaufman Publishers, Inc., pp. iii, v-xi, and 227-262 (1998).

Herley et al., "Tilings of the Time-Frequency Plane: Construction of Arbitrary Orthogonal Bases and Fast Tiling Algorithms," IEEE Transactions on Signal Processing, vol. 41, No. 12, pp. 3341-3359 (1993).

ITU, Recommendation ITU-R BS 1387, Method for Objective Measurements of Perceived Audio Quality, 89 pp. (1998).

ITU, Recommendation ITU-R BS 1115, Low Bit-Rate Audio Coding, 9 pp. (1994).

Jesteadt et al., "Forward Masking as a Function of Frequency, Masker Level, and Signal Delay," Journal of Acoustical Society of America, 71:950-962 (1982).

A.M. Kondoz, Digital Speech: Coding for Low Bit Rate Communications Systems, "Chapter 3.3: Linear Predictive Modeling of Speech Signals" and "Chapter 4: LPC Parameter Quantisation Using LSFs," John Wiley & Sons, pp. 42-53 and 79-97 (1994).

Lufti, "Additivity of Simultaneous Masking," Journal of Acoustic Society of America, 73:262-267 (1983).

Malvar, "Biorthogonal and Nonuniform Lapped Transforms for Transform Coding with Reduced Blocking and Ringing Artifacts," appeared in IEEE Transactions on Signal Processing, Special Issue on Multirate Systems, Filter Banks, Wavelets, and Applications, vol. 46, 29 pp. (1998).

H.S. Malvar, "Lapped Transforms for Efficient Transform/Subband Coding," IEEE Transactions on Acoustics, Speech and Signal Processing, vol. 38, No. 6, pp. 969-978 (1990).

H.S. Malvar, Signal Processing with Lapped Transforms, Artech House, Norwood, MA, pp. iv, vii-xi, 175-218, and 353-357 (1992).

OPTICOM GmbH, "Objective Perceptual Measurement," 14 pp. [Downloaded from the World Wide Web on Oct. 24, 2001.].

Phamdo, "Speech Compression," 13 pp. [Downloaded from the World Wide Web on Nov. 25, 2001.].

Ribas Corbera et al., "Rate Control in DCT Video Coding for Low-Delay Communications," IEEE Transactions on Circuits and Systems for Video Technology, vol. 9, No. 1, pp. 172-185 (Feb. 1999).

Seymour Shlien, "The Modulated Lapped Transform, Its Time-Varying Forms, and Its Application to Audio Coding Standards," IEEE Transactions on Speech and Audio Processing, vol. 5, No. 4, pp. 359-366 (Jul. 1997).

Solari, Digital Video and Audio Compression, Title Page, Contents, "Chapter 8: Sound and Audio," McGraw-Hill, Inc., pp. iii, v-vi, and 187-211 (1997).

Srinivasan et al., "High-Quality Audio Compression Using an Adaptive Wavelet Packet Decomposition and Psychoacoustic Modeling," IEEE Transactions on Signal Processing, vol. 46, No. 4, pp. 1085-1093 (Apr. 1998).

Terhardt, "Calculating Virtual Pitch," Hearing Research, 1:155-182 (1979).

Wragg et al., "An Optimised Software Solution for an ARM PoweredTM MP3 Decoder," 9 pp. [Downloaded from the World Wide Web on Oct. 27, 2001.].

Zwicker et al., Das Ohr als Nachrichtenempfänger, Title Page, Table of Contents, "I: Schallschwingungen," Index, Hirzel-Verlag, Stuttgart, pp. III, IX-XI, 1-26, and 231-232 (1967).

Zwicker, Psychoakustik, Title Page, Table of Contents, "Teil I: Einfuhrung," Index, Springer-Verlag, Berlin Heidelberg, New York, pp. II, IX-XI, 1-30, and 157-162 (1982).

U.S. Appl. No. 10/882,801, filed Jun. 29, 2004, Mehrotra et al.

H. S. Malvar, "Biorthogonal and nonuniform lapped transforms for transform coding with reduced blocking and ringing artifacts", *IEEE Transactions on Signal Processing*, vol. 46, pp. 1043-1053, Apr. 1998.

R. Cox, "The design of uniformly and nonuniformly spaced pseudoquadrature mirror filters" *IEEE Transactions on Acoustics, Speech, and Signal Processing*, vol. 34, pp. 1090-1096, Oct. 1986.

H. S. Malvar, "Enhancing the performance of subband audio coders for speech signals", *Proc. 1998 IEEE International Symposium on Circuits and Systems*, vol. 5, pp. 98-101, Jun. 1998.

O. A. Niamut and R. Heusdens, "Subband merging in cosine-modulated filter banks", IEEE Signal Processing Letters, vol. 10, pp. 111-114, Apr. 2003.

Liang et al., "Fast Multiplierless Approximation of the DCT with the Lifting Scheme," *Proc. SPIE Apps. of Digital Image Processing XXIII*, 12 pp. (Aug. 2000).

ISO/IEC 11172-3, Information Technology—Coding of Moving Pictures and Associated Audio for Digital Storage Media at Up to About 1.5 Mbit/s—Part 3: Audio, 154 pp. (1993).

Advanced Television Systems Committee, "ATSC Standard: Digital Audio Compression (AC-3), Revision A," pp. 1-140 (August 2001).

ISO/IEC 13818-7, "Information Technology-Generic Coding of Moving Pictures and Associated Audio Information," Part 7: Advanced Audio Coding (AAC), pp. i-iv, 1-145 (1997).

ISO/IEC 13818-7, Technical Corrigendum 1, "Information Technology-Generic Coding of Moving Pictures and Associated Audio Information," Part 7: Advanced Audio Coding (AAC), Technical Corrigendum, pp. 1-22 (1997).

Brandenburg, "ASPEC Coding", *AES 10th International Conference*, pp. 81-90 (1991).

Bjontegaard, "H.26L Test Model Long Term Number 8 (TML-8) Draft 0," *Video Coding Experts Group* (*VCEG*), pp. 1-46.

Calderbank et al., "Wavelet Transforms that Map Integers to Integers," pp. 1-39 (Aug. 1996).

Cham, "Development of Integer Cosine Transforms by the Principle of Dyadic Symmetry," *IEE Proceedings*, vol. 136, Pt. 1, No. 4, pp. 276-282 (Aug. 1989).

Liang et al., "A 16-bit Architecture for H.26L, Treating DCT Transforms and Quantization," *Thirteenth Meeting: Austin, Texas, USA*, pp. 1-17 (Apr. 2001).

Li et al., "On Implementing Transforms from Integers to Integers," *Department of Electrical Engineering, Princeton University*, pp. 881-885, Jun. 1998.

Rubino et al., "Improved Chen-Smith Image Coder," *Electrical Engineering Department, Iniversity of Texas at Arlington*, pp. 267-270, 1993.

J. W. Cooley and J. W. Tukey, "An algorithm for the machine calculation of complex Fourier series," *Math. Computation*, vol. 19, pp. 297-301, 1965.

W. Chen, C. H. Smith, and S. C. Fralick, "A fast computational algorithm for the discrete cosine transform," *IEEE Trans. Commun.*, vol. 25, pp. 1004-1009, Sep. 1977.

H. Malvar, "Fast computation of the discrete cosine transform and the discrete Hartley transform," *IEEE Trans. Acoust., Speech, Signal Processing*, vol. ASSP-35, pp. 1484-1485, Oct. 1987.

C. Loeffler et al., "Practical fast 1-D DCT algorithms with 11 multiplications," *Proc. IEEE ICASSP*, vol. 2, pp. 988-991, Feb. 1989.

Arai, et al., "A Fast DCT-SQ Scheme for Images," The Transactions of the IEICE, vol. E 71, No. 11, Nov. 1988, pp. 1095-1097.

Korhonen et al., "Schemes for Error Resilient Streaming of Perceptually Coded Audio," *Proceedings of the 2003 IEEE International Conference on Acoustics, Speech & Signal Processing*, 2003, pp. 165-168.

Noll, "Digital Audio Coding for Visual Communications," *Proceedings of the IEEE*, vol. 83, No. 6, Jun. 1995, pp. 925-943.

* cited by examiner

1300

$$\begin{bmatrix} 1 & 0 & 0 & 0 & 0 & 0 & 0 & 0 \\ 0 & 1 & 0 & 0 & 0 & 0 & 0 & 0 \\ 0 & 0 & 1 & 0 & 0 & 0 & 0 & 0 \\ 0 & 0 & 0 & 1 & 0 & 0 & 0 & 0 \\ 0 & 0 & 0 & 0 & 1/\sqrt{2} & 1/\sqrt{2} & 0 & 0 \\ 0 & 0 & 0 & 0 & 1/\sqrt{2} & -1/\sqrt{2} & 0 & 0 \\ 0 & 0 & 0 & 0 & 0 & 0 & 1/\sqrt{2} & 1/\sqrt{2} \\ 0 & 0 & 0 & 0 & 0 & 0 & 1/\sqrt{2} & -1/\sqrt{2} \end{bmatrix}$$

1304 1302

1400

CODING WITH IMPROVED TIME RESOLUTION FOR SELECTED SEGMENTS VIA ADAPTIVE BLOCK TRANSFORMATION OF A GROUP OF SAMPLES FROM A SUBBAND DECOMPOSITION

BACKGROUND

Transform coding is a compression technique often used in digital media compression systems. Uncompressed digital media, such as an audio or video signal is typically represented as a stream of amplitude samples of a signal taken at regular time intervals. For example, a typical format for audio on compact disks consists of a stream of sixteen-bit samples per channel of the audio (e.g., the original analog audio signal from a microphone) captured at a rate of 44.1 KHz. Each sample is a sixteen-bit number representing the amplitude of the audio signal at the time of capture. Other digital media systems may use various different amplitude and time resolutions of signal sampling.

Uncompressed digital media can consume considerable storage and transmission capacity. Transform coding reduces the size of digital media by transforming the time-domain representation of the digital media into a frequency-domain (or other like transform domain) representation, and then reducing resolution of certain generally less perceptible frequency components of the frequency-domain representation. This generally produces much less perceptible degradation of the signal compared to reducing amplitude or time resolution of digital media in the time domain.

More specifically, a typical audio transform coding technique divides the uncompressed digital audio's stream of time-samples into fixed-size subsets or blocks, each block possibly overlapping with other blocks. A linear transform that does time-frequency analysis is applied to each block, which converts the time interval audio samples within the block to a set of frequency (or transform) coefficients generally representing the strength of the audio signal in corresponding frequency bands over the block interval. For compression, the transform coefficients may be selectively quantized (i.e., reduced in resolution, such as by dropping least significant bits of the coefficient values or otherwise mapping values in a higher resolution number set to a lower resolution), and also entropy or variable-length coded into a compressed audio data stream. At decoding, the transform coefficients will inversely transform to nearly reconstruct the original amplitude/time sampled audio signal.

Many audio compression systems utilize the Modulated Lapped Transform (MLT, also known as Modified Discrete Cosine Transform or MDCT) to perform the time-frequency analysis in audio transform coding. MLT reduces blocking artifacts introduced into the reconstructed audio signal by quantization. More particularly, when non-overlapping blocks are independently transform coded, quantization errors will produce discontinuities in the signal at the block boundaries upon reconstruction of the audio signal at the decoder.

One problem in audio coding is commonly referred to as "pre-echo." Pre-echo occurs when the audio undergoes a sudden change (referred to as a "changing signal characteristic"). For example, a changing signal characteristic such as a transient. In transform coding, particular frequency coefficients commonly are quantized (i.e., reduced in resolution). When the transform coefficients are later inverse-transformed to reproduce the audio signal, this quantization introduces quantization noise that is spread over the entire block in the time domain. This inherently causes rather uniform smearing of noise within the coding frame. The noise, which generally is tolerable for some part of the frame, can be audible and disastrous to auditory quality during portions of the frame where the masking level is low. In practice, this effect shows up most prominently when a signal has a sharp attack immediately following a region of low energy, hence the term "pre-echo." "Post-echo" is a changing signal characteristic that occurs when the signal transition from high to low energy is less of a problem to perceptible auditory quality due to a property of the human auditory system.

Thus, what is needed is a system that addresses the pre-echo effect by reducing the smearing of quantization noise over a large signal frame.

SUMMARY

A transform coder is described that performs an additional time-split transform selectively based on characteristics of media data. A transient detection component identifies changing signal characteristic locations, such as transient locations to apply a time-split transform. For example, a slow transition between two types of signals is usually not considered a transient and yet the described technology provides benefits for such changing signal characteristics. An encoding component transforms an input signal from a time domain to a transform domain. A time-splitting transformer component selectively performs an orthogonal sum-difference transform on adjacent coefficients indicated by the identified changing signal characteristic location. The orthogonal sum/difference transform results in transforming a vector of coefficients in the transform domain as if they were multiplied selectively by one or more exemplary time-split transform matrices.

In other examples, a window configuration component configures window sizes so as to place one or more small window sizes in areas of transient locations and large window sizes in other areas. The encoding component inverse-transforms to produce a reconstructed version of the input signal and a quality measurement component measures the achieved quality of the reconstructed signal. The window configuration component adjusts window sizes according to the achieved quality. The quality measurement component further operates to measure achieved perceptual quantization noise of the reconstructed signal. The window configuration component further operates to increase a window size where the measure of achieved perceptual quantization noise exceeds an acceptable threshold. The quality measurement component further operates to detect pre-echo in the reconstructed signal and the window configuration component further operates to decrease window size where pre-echo is detected.

A transform decoder provides an inverse time-splitting transformer and an inverse transformer. The inverse time-splitting transformer receives side information and coefficient data in a transform domain and selectively performs an inverse orthogonal sum-difference transformation on adjacent coefficients indicated in received side information. Next, the inverse transformer transforms coefficient data from the transform domain to a time domain.

In other examples, an inverse window configuration component receives side information about window and sub-frame sizes and the inverse transformer transforms coefficient data according to the window and sub-band sizes. In one such example, the inverse orthogonal sum-difference transformation results in transforming a vector of coefficients in the transform domain as if it were multiplied by an inverse of a time-splitting transform. In another example, the inverse time-splitting transformer component receives side information indicating that there are no time-splits in at least one sub-frame, and in another example, the side information indicates whether or not there is a time-split in an extended band.

A method of decoding receives side information and coefficient data in a transform domain. The method selectively performs an inverse time-split transform on adjacent coefficients as indicated in received side information and further transforms the coefficient data from the transform domain to a time domain. In another example, the method identifies sub-frame sizes in received side information and the inverse transform is performed according to the identified sub-frame sizes. In yet another example, the side information indicates whether there is a time-split in a sub-band, or whether or not there is a time-split in each sub-band in an extended band. In another example, the method determines a pair of adjacent coefficients in a transform domain on which to perform an inverse sum-difference transform.

Additional features and advantages of the invention will be made apparent from the following detailed description of embodiments that proceeds with reference to the accompanying drawings.

DETAILED DESCRIPTION

Brief Overview

Figure 1:
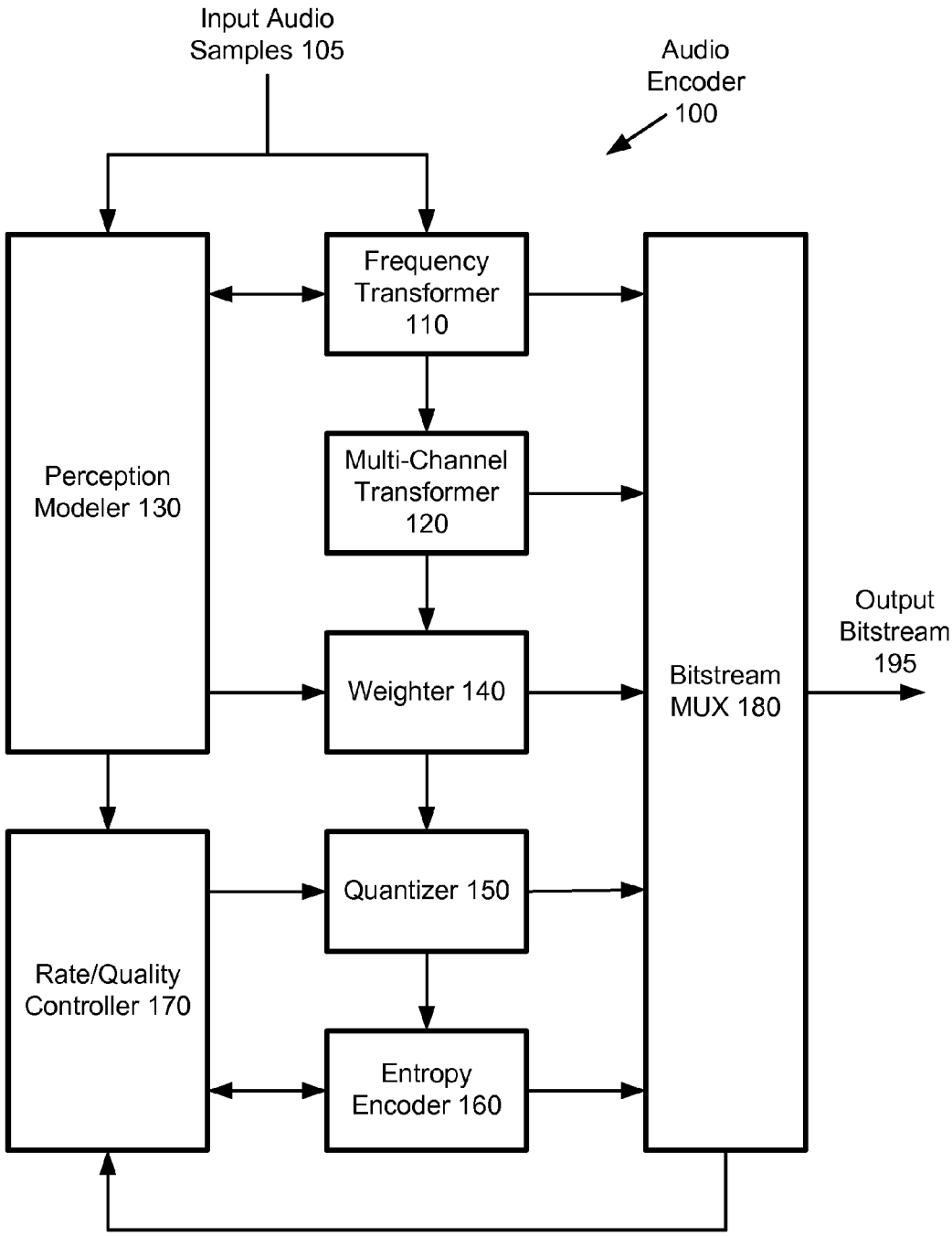
FIG. 1 (PRIOR ART)
FIG. 1 is a block diagram of an exemplary audio encoder performing selective time-split transform.

The following describes a transform coder capable of performing an additional time-split transform selectively based on characteristics of spectral digital media data.

Optionally, an adaptive window size is provided when a selective time-split transform does not produce a sufficient benefit. The coder selects one or more window sizes within a frame of spectral digital media data. Spectral Data analysis (e.g., changing signal characteristic detection) identifies one or more frequencies for a time-split transform. If the results of a time-split transform are not sufficient, then a window size may be adapted. Optionally, using one or more passes at time-split transform, data energy analysis, and or window size adaptation provides improved coding efficiency overall.

When providing a sub-band decomposition for coding of data, with overlapped or block based transform, or when using a filterbank (which can also be represented as an overlapped transform), the sub-band structure is typically fixed. When providing an overlapped transform (such as modulated lapped transform (MLT)), the sub-frame size can be varied which results in adapting the time/frequency resolution depending on signal characteristics. However, there are certain cases in which using a large sub-frame size (better frequency resolution, lower time resolution) provides efficient coding, but results in noticeable artifacts at higher frequencies. In order to remove these artifacts, various possible features are described for reducing artifacts. For example, a block based transform (e.g., a time-split transform) is applied subsequent to an existing fixed transform (e.g., a discrete cosine (DCT transform, a MLT transform, etc.)). In one example, the time-split transform is used selectively to provide better time resolution upon determining that the time-split transform is beneficial for one or more select groups of frequency coefficients. The frequency selections is based on detected energy change.

If there are only certain regions of the frequency that need better time resolution, then using a smaller time window can result in a significant increase in the number of bits needed to code the spectral data. If sufficient bits are available this is not an issue, and a smaller time window should be used. However, when there are not enough bits, using a selective time-split transform on only those frequency ranges where it is needed can provide improved quality.

A time-split transform improves data coding when better time resolution is needed for coding of certain frequencies. A time-split transform and or various other features described herein can be used in any media encoder or decoder. For example, a time-split transform can be used with the digital media codec techniques described by Mehrotra et. al., "Efficient Coding of Digital Media Spectral Data Using Wide-Sense Perceptual Similarity" U.S. patent application Ser. No. 10/882,801, filed Jun. 29, 2004. For example, a time-split transform can be used to improve coding of high, medium, or low frequencies.

Exemplary Encoder and Decoder

FIG. 1 is a block diagram of a generalized audio encoder (100). The relationships shown between modules within the encoder and decoder indicate the main flow of information in the encoder and decoder; other relationships are not shown for the sake of simplicity. Depending on implementation and the type of compression desired, modules of the encoder or decoder can be added, omitted, divided into multiple modules, combined with other modules, and/or replaced with like modules. In alternative embodiments, encoders or decoders with different modules and/or other configurations of modules perform time-split transforms.

The generalized audio encoder (100) includes a frequency transformer (110), a multi-channel transformer (120), a perception modeler (130), a weighter (140), a quantizer (150), an entropy encoder (160), a rate/quality controller (170), and a bitstream multiplexer ["MUX"] (180).

The encoder (100) receives a time series of input audio samples (105). For input with multiple channels (e.g., stereo mode), the encoder (100) processes channels independently, and can work with jointly coded channels following the multi-channel transformer (120). The encoder (100) compresses the audio samples (105) and multiplexes information produced by the various modules of the encoder (100) to output a bitstream (195) in a format such as Windows Media Audio ["WMA"] or Advanced Streaming Format ["ASF"]. Alternatively, the encoder (100) works with other input and/or output formats.

The frequency transformer (110) receives the audio samples (105) and converts them into data in the frequency domain. The frequency transformer (110) splits the audio samples (105) into blocks, which can have variable size to allow variable temporal resolution. Small blocks allow for greater preservation of time detail at short but active transition segments in the input audio samples (105), but sacrifice some frequency resolution. In contrast, large blocks have better frequency resolution and worse time resolution, and usually allow for greater compression efficiency at longer and less active segments. Blocks can overlap to reduce perceptible discontinuities between blocks that could otherwise be introduced by later quantization. The frequency transformer selectively applies a time-split transform based on characteristics of the data. The frequency transformer (110) outputs blocks of frequency coefficient data to the multi-channel transformer (120) and outputs side information such as block sizes to the MUX (180). The frequency transformer (110) outputs both the frequency coefficient data and the side information to the perception modeler (130).

The frequency transformer (110) partitions a frame of audio input samples (105) into overlapping sub-frame blocks with time-varying size and applies a time-varying MLT to the sub-frame blocks. Possible sub-frame sizes include 128, 256, 512, 1024, 2048, and 4096 samples. The MLT operates like a DCT modulated by a time window function, where the window function is time varying and depends on the sequence of sub-frame sizes. The MLT transforms a given overlapping block of samples $x[n], 0 \leqq n < subframe_size$ into a block of frequency coefficients $X[k], 0 \leqq k < subframe_size/2$. The frequency transformer (110) can also output estimates of the complexity of future frames to the rate/quality controller (170). Alternative embodiments use other varieties of MLT. In still other alternative embodiments, the frequency transformer (110) applies a DCT, FFT, or other type of modulated or non-modulated, overlapped or non-overlapped frequency transform, or use subband or wavelet coding. Typically after the transform to the frequency domain, the frequency transformer selectively applies a time-split transform based on characteristics of the data.

For multi-channel audio data, the multiple channels of frequency coefficient data produced by the frequency transformer (110) often correlate. To exploit this correlation, the multi-channel transformer (120) can convert the multiple original, independently coded channels into jointly coded channels. For example, if the input is stereo mode, the multi-channel transformer (120) can convert the left and right channels into sum and difference channels:

$$X_{Sum}[k] = \frac{X_{Left}[k] + X_{Right}[k]}{2}$$

$$X_{Diff}[k] = \frac{X_{Left}[k] - X_{Right}[k]}{2}$$

Or, the multi-channel transformer (120) can pass the left and right channels through as independently coded channels. More generally, for a number of input channels greater than one, the multi-channel transformer (120) passes original, independently coded channels through unchanged or converts the original channels into jointly coded channels. The decision to use independently or jointly coded channels can be predetermined, or the decision can be made adaptively on a block by block or other basis during encoding. The multi-channel transformer (120) produces side information to the MUX (180) indicating the channel mode used.

The perception modeler (130) models properties of the human auditory system to improve the quality of the reconstructed audio signal for a given bitrate. The perception modeler (130) computes the excitation pattern of a variable-size block of frequency coefficients. First, the perception modeler (130) normalizes the size and amplitude scale of the block. This enables subsequent temporal smearing and establishes a consistent scale for quality measures. Optionally, the perception modeler (130) attenuates the coefficients at certain frequencies to model the outer/middle ear transfer function. The perception modeler (130) computes the energy of the coefficients in the block and aggregates the energies by 25 critical bands. Alternatively, the perception modeler (130) uses another number of critical bands (e.g., 55 or 109). The frequency ranges for the critical bands are implementation-dependent, and numerous options are well known. For example, see ITU-R BS 1387 or a reference mentioned therein. The perception modeler (130) processes the band energies to account for simultaneous and temporal masking. In alternative embodiments, the perception modeler (130) processes the audio data according to a different auditory model, such as one described or mentioned in ITU-R BS 1387.

The weighter (140) generates weighting factors (alternatively called a quantization matrix) based upon the excitation pattern received from the perception modeler (130) and applies the weighting factors to the data received from the multi-channel transformer (120). The weighting factors include a weight for each of multiple quantization bands in the audio data. The quantization bands can be the same or different in number or position from the critical bands used elsewhere in the encoder (100). The weighting factors indicate proportions at which noise is spread across the quantization bands, with the goal of minimizing the audibility of the noise by putting more noise in bands where it is less audible, and vice versa. The weighting factors can vary in amplitudes and number of quantization bands from block to block. In one implementation, the number of quantization bands varies according to block size; smaller blocks have fewer quantization bands than larger blocks. For example, blocks with 128 coefficients have 13 quantization bands, blocks with 256 coefficients have 15 quantization bands, up to 25 quantization bands for blocks with 2048 coefficients. The weighter (140) generates a set of weighting factors for each channel of multi-channel audio data in independently coded channels, or generates a single set of weighting factors for jointly coded channels. In alternative embodiments, the weighter (140)

generates the weighting factors from information other than or in addition to excitation patterns.

The weighter (140) outputs weighted blocks of coefficient data to the quantizer (150) and outputs side information such as the set of weighting factors to the MUX (180). The weighter (140) can also output the weighting factors to the rate/quality controller (140) or other modules in the encoder (100). The set of weighting factors can be compressed for more efficient representation. If the weighting factors are lossy compressed, the reconstructed weighting factors are typically used to weight the blocks of coefficient data. If audio information in a band of a block is completely eliminated for some reason (e.g., noise substitution or band truncation), the encoder (100) may be able to further improve the compression of the quantization matrix for the block.

The quantizer (150) quantizes the output of the weighter (140), producing quantized coefficient data to the entropy encoder (160) and side information including quantization step size to the MUX (180). Quantization introduces irreversible loss of information, but also allows the encoder (100) to regulate the bitrate of the output bitstream (195) in conjunction with the rate/quality controller (170). In FIG. 1, the quantizer (150) is an adaptive, uniform scalar quantizer. The quantizer (150) applies the same quantization step size to each frequency coefficient, but the quantization step size itself can change from one iteration to the next to affect the bitrate of the entropy encoder (160) output. In alternative embodiments, the quantizer is a non-uniform quantizer, a vector quantizer, and/or a non-adaptive quantizer.

The entropy encoder (160) losslessly compresses quantized coefficient data received from the quantizer (150). For example, the entropy encoder (160) uses multi-level run length coding, variable-to-variable length coding, run length coding, Huffman coding, dictionary coding, arithmetic coding, LZ coding, a combination of the above, or some other entropy encoding technique.

The rate/quality controller (170) works with the quantizer (150) to regulate the bitrate and quality of the output of the encoder (100). The rate/quality controller (170) receives information from other modules of the encoder (100). In one implementation, the rate/quality controller (170) receives estimates of future complexity from the frequency transformer (110), sampling rate, block size information, the excitation pattern of original audio data from the perception modeler (130), weighting factors from the weighter (140), a block of quantized audio information in some form (e.g., quantized, reconstructed, or encoded), and buffer status information from the MUX (180). The rate/quality controller (170) can include an inverse quantizer, an inverse weighter, an inverse multi-channel transformer, and, potentially, an entropy decoder and other modules, to reconstruct the audio data from a quantized form.

The rate/quality controller (170) processes the information to determine a desired quantization step size given current conditions and outputs the quantization step size to the quantizer (150). The rate/quality controller (170) then measures the quality of a block of reconstructed audio data as quantized with the quantization step size, as described below. Using the measured quality as well as bitrate information, the rate/quality controller (170) adjusts the quantization step size with the goal of satisfying bitrate and quality constraints, both instantaneous and long-term. In alternative embodiments, the rate/quality controller (170) applies works with different or additional information, or applies different techniques to regulate quality and bitrate.

In conjunction with the rate/quality controller (170), the encoder (100) can apply noise substitution, band truncation, and/or multi-channel rematrixing to a block of audio data. At low and mid-bitrates, the audio encoder (100) can use noise substitution to convey information in certain bands. In band truncation, if the measured quality for a block indicates poor quality, the encoder (100) can completely eliminate the coefficients in certain (usually higher frequency) bands to improve the overall quality in the remaining bands. In multi-channel rematrixing, for low bitrate, multi-channel audio data in jointly coded channels, the encoder (100) can suppress information in certain channels (e.g., the difference channel) to improve the quality of the remaining channel(s) (e.g., the sum channel).

The MUX (180) multiplexes the side information received from the other modules of the audio encoder (100) along with the entropy encoded data received from the entropy encoder (160). The MUX (180) outputs the information in WMA or in another format that an audio decoder recognizes.

The MUX (180) includes a virtual buffer that stores the bitstream (195) to be output by the encoder (100). The virtual buffer stores a pre-determined duration of audio information (e.g., 5 seconds for streaming audio) in order to smooth over short-term fluctuations in bitrate due to complexity changes in the audio. The virtual buffer then outputs data at a relatively constant bitrate. The current fullness of the buffer, the rate of change of fullness of the buffer, and other characteristics of the buffer can be used by the rate/quality controller (170) to regulate quality and bitrate.

Figure 2:
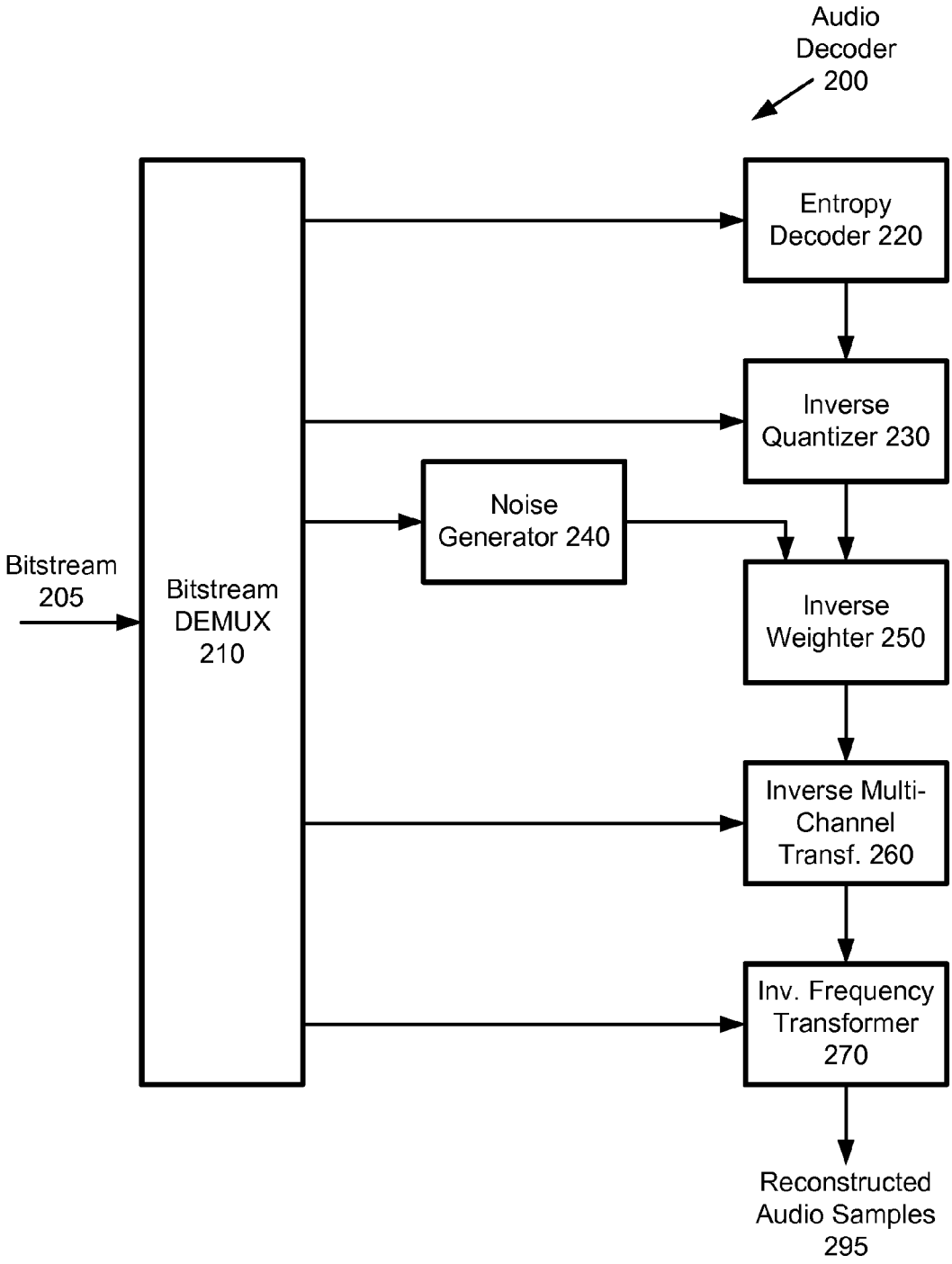
FIG. 2 (PRIOR ART)
FIG. 2 is a block diagram of an exemplary audio decoder performing inverse selective time-split transform.

With reference to FIG. 2, the generalized audio decoder (200) includes a bitstream demultiplexer ["DEMUX"] (210), an entropy decoder (220), an inverse quantizer (230), a noise generator (240), an inverse weighter (250), an inverse multi-channel transformer (260), and an inverse frequency transformer (270). The decoder (200) is often simpler than the encoder (100) because the decoder (200) does not include modules for rate/quality control.

The decoder (200) receives a bitstream (205) of compressed audio data in WMA or another format. The bitstream (205) includes entropy encoded data as well as side information from which the decoder (200) reconstructs audio samples (295). For audio data with multiple channels, the decoder (200) processes each channel independently, and can work with jointly coded channels before the inverse multi-channel transformer (260).

The DEMUX (210) parses information in the bitstream (205) and sends information to the modules of the decoder (200). The DEMUX (210) includes one or more buffers to compensate for short-term variations in bitrate due to fluctuations in complexity of the audio, network jitter, and/or other factors.

The entropy decoder (220) losslessly decompresses entropy codes received from the DEMUX (210), producing quantized frequency coefficient data. The entropy decoder (220) typically applies the inverse of the entropy encoding technique used in the encoder.

The inverse quantizer (230) receives a quantization step size from the DEMUX (210) and receives quantized frequency coefficient data from the entropy decoder (220). The inverse quantizer (230) applies the quantization step size to the quantized frequency coefficient data to partially reconstruct the frequency coefficient data. In alternative embodiments, the inverse quantizer applies the inverse of some other quantization technique used in the encoder.

The noise generator (240) receives from the DEMUX (210) indication of which bands in a block of data are noise substituted as well as any parameters for the form of the noise.

The noise generator (240) generates the patterns for the indicated bands, and passes the information to the inverse weighter (250).

The inverse weighter (250) receives the weighting factors from the DEMUX (210), patterns for any noise-substituted bands from the noise generator (240), and the partially reconstructed frequency coefficient data from the inverse quantizer (230). As necessary, the inverse weighter (250) decompresses the weighting factors. The inverse weighter (250) applies the weighting factors to the partially reconstructed frequency coefficient data for bands that have not been noise substituted. The inverse weighter (250) then adds in the noise patterns received from the noise generator (240).

The inverse multi-channel transformer (260) receives the reconstructed frequency coefficient data from the inverse weighter (250) and channel mode information from the DEMUX (210). If multi-channel data is in independently coded channels, the inverse multi-channel transformer (260) passes the channels through. If multi-channel data is in jointly coded channels, the inverse multi-channel transformer (260) converts the data into independently coded channels. If desired, the decoder (200) can measure the quality of the reconstructed frequency coefficient data at this point.

The inverse frequency transformer (270) receives the frequency coefficient data output by the multi-channel transformer (260) as well as side information such as block sizes from the DEMUX (210). The inverse frequency transformer (270) applies the inverse time-split transform selectively (as indicated by the side information), and applies the inverse of the frequency transform used in the encoder and outputs blocks of reconstructed audio samples (295).

Exemplary Transform with Selective Time-Split

Figure 3:
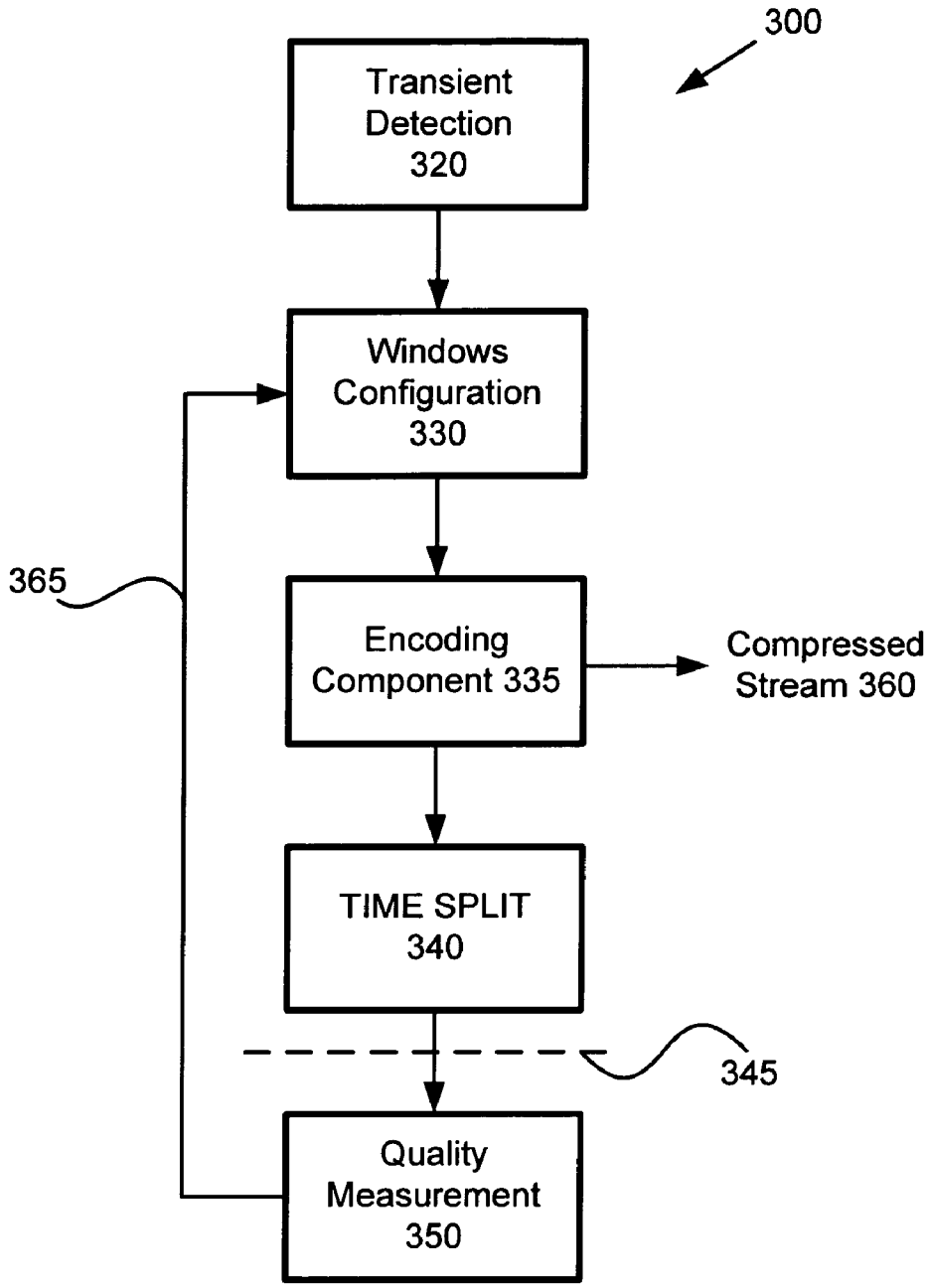
FIG. 3 is a block diagram of an exemplary transform coder performing selective time-split transform.

FIG. 3 shows a transform coder 300 with selective time-split transform. The transform coder 300 can be realized within the generalized audio encoder 100 described above. The transform coder 300 alternatively can be realized in audio encoders that include fewer or additional encoding processes than the described, generalized audio encoder 100. Also, the transform coder 300 can be realized in encoders of signals other than audio.

A transform coder 110 need not employ adaptive window sizing. In one such an example, a default window size is used to transform coefficients from the time domain to the transform domain (e.g., frequency domain). Changing signal characteristic detection is used to determine where to selectively apply a time-split transform to coefficients in the frequency domain.

Optionally, a time-split transform may be used in conjunction with adaptive window sizing. The transform coder 300 utilizes a one or more pass process to select window sizes for transform coding. In a first, open-loop pass, the transform coder detects changing signal characteristics in the input signal, and selectively performs a time-split transform. An initial window configuration may or may not take changing signal characteristic detection into consideration. Optionally, window sizes may be adapted before or after selectively applying a time-split transform.

When window size adaptation is employed for an initial window-size configuration, the transform coder places one or more small windows over changing signal characteristic regions and places large windows in frames without changing signal characteristics. The transform coder first transform codes, time-split transforms (selectively) and then reconstructs the signal using the initial window configuration, so that it can then analyze auditory quality of transform coding using the initial window configuration. Based on the quality measurement, the transform coder adjusts window sizes, either combining to form larger windows to improve coding efficiency to achieve a desired bit-rate, or dividing to form smaller windows to avoid pre-echo. To save on computation, the transform coder 300 can use the quality measured on the previous frame to make adjustments to the window configuration of the current frame, thereby merging the functionality of the two passes, without having to re-code.

With reference to a particular example shown in FIG. 3, the transform coder 300 comprises components for changing signal characteristic detection 320, windows configuration 330, encoding 335, and selective time-split transform 340. Optionally 345, quality measurement 350 is used to provide one or more window configurations 365.

Figure 4:
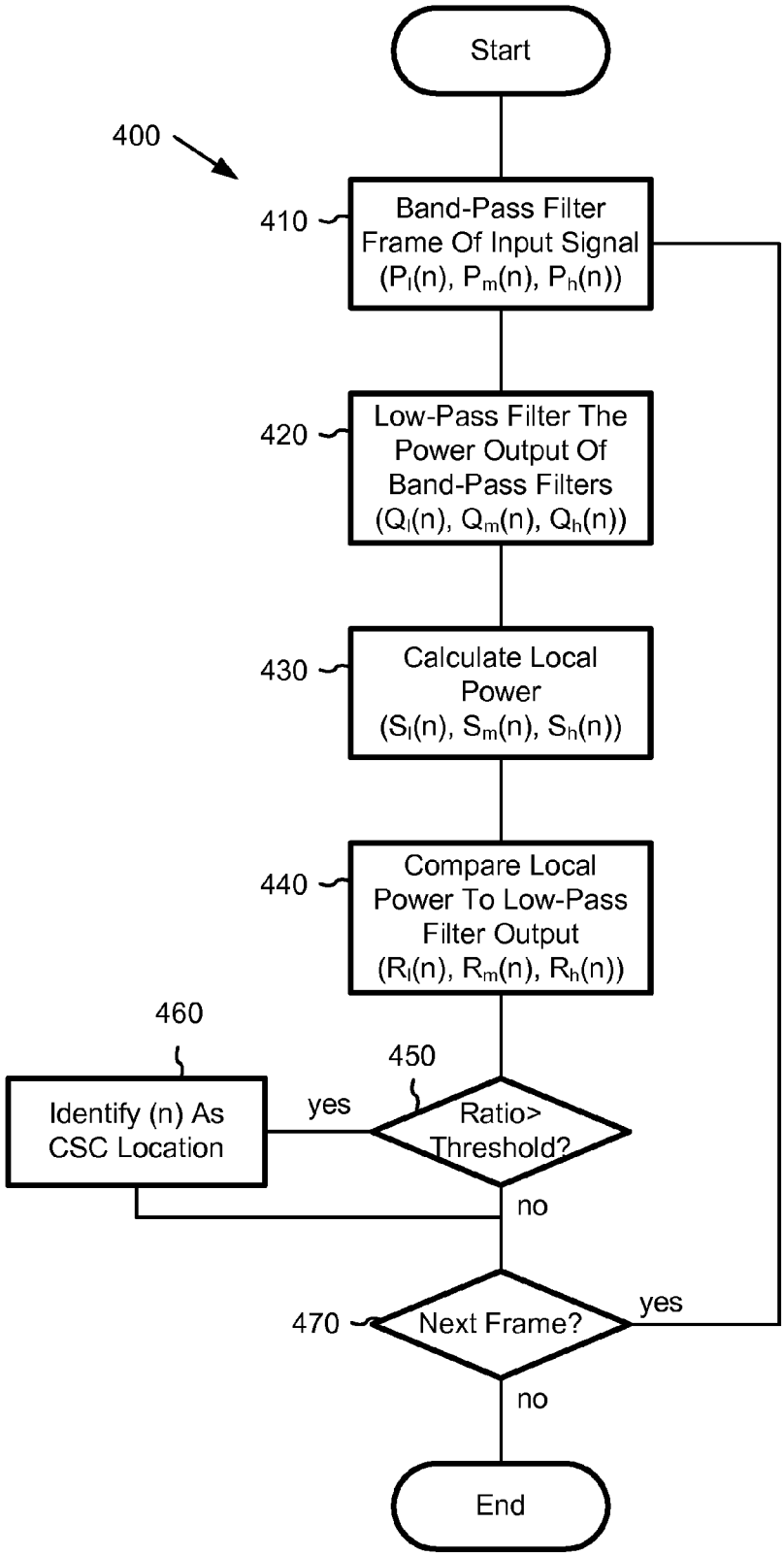
FIG. 4 (PRIOR ART)
FIG. 4 is a flow chart of an exemplary changing signal characteristic detection process.

The changing signal characteristic detection component 320 detects regions of the input signal that exhibit characteristics of a changing signal characteristic, and identifies such regions to the windows configuration component 330. The changing signal characteristic detection component 320 can use various conventional techniques to detect changing signal characteristic regions in the input signal. An exemplary changing signal characteristic detection process 400 is illustrated in FIG. 4, and described below.

Figure 5:
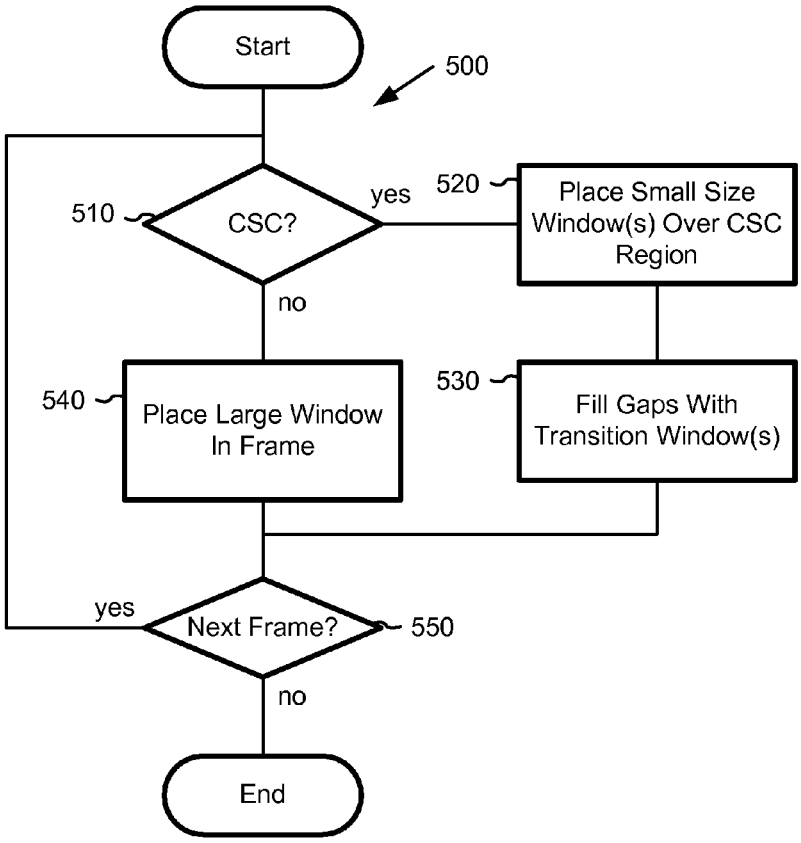
FIG. 5 (PRIOR ART)
FIG. 5 is a flow chart of an exemplary window configuration process.
Figure 7:
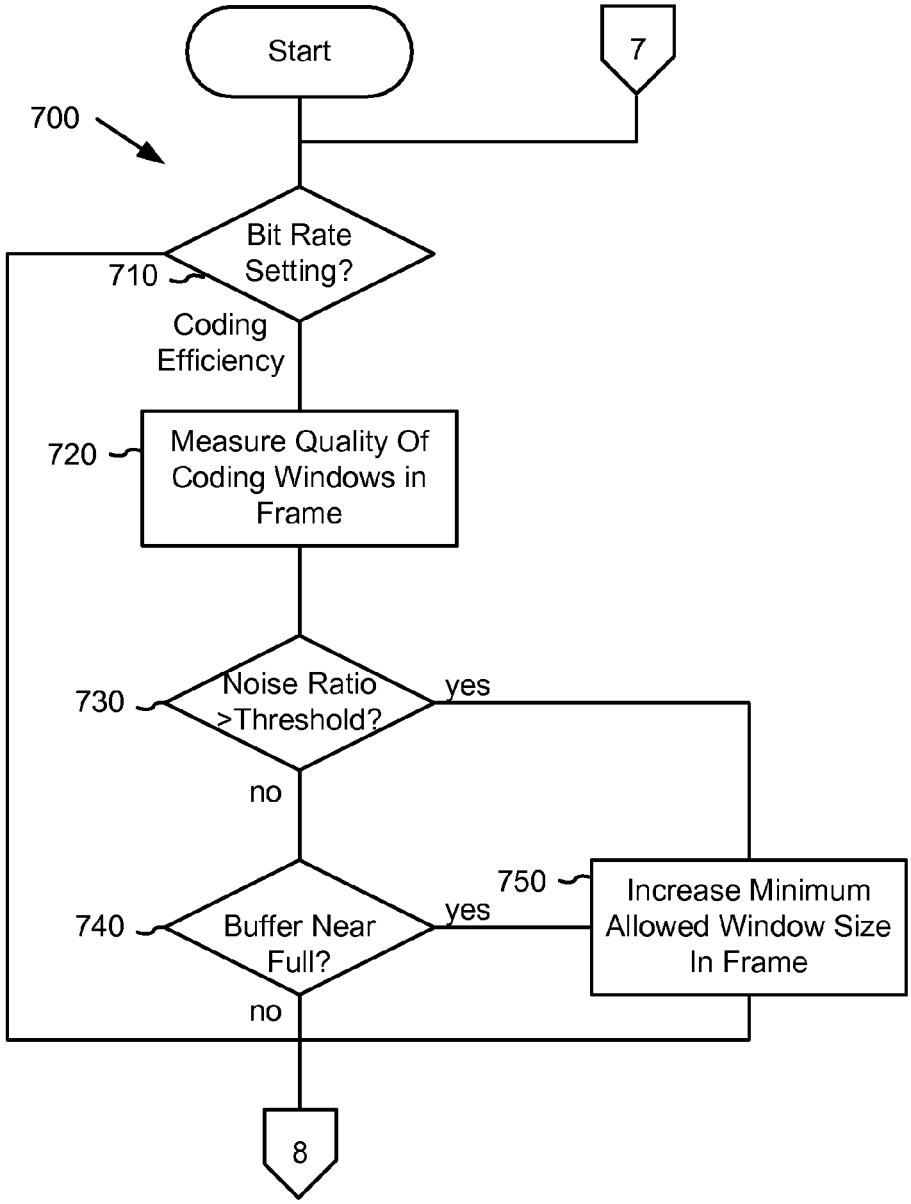
FIG. 7 (PRIOR ART)
FIG. 7 is a flow chart of an exemplary windows configuration process.

The windows configuration component 330 configures windows sizes for transform coding. An initial window configuration may be provided based on results of changing signal characteristic detection. An initial window configuration may also be provided by a default configuration without considering changing signal characteristic detection. An initial configuration may be determined on an open-loop basis based on the changing signal characteristic locations identified by the changing signal characteristic detector component 320. An exemplary open-loop windows configuration process 500 is illustrated in FIG. 5, and described below. Optionally, on a second iteration 365, the windows configuration component 330 adjusts the initial window sizes from the initial configuration based on closed-loop feedback 365 from the quality measurement component 350, to produce a next configuration. An exemplary closed-loop windows configuration process 700 is illustrated in FIG. 7, and described below.

The encoding component 335 implements processes for transform coding (e.g., DCT transform, etc.), rate control, quantization and their inverse processes, and may encompass the various components that implement these processes in the generalized audio encoder 100 and decoder 200 described above. The encoding component 335 initially transform codes (with rate control and quantization) the input signal using the initial window size configuration produced by the windows configuration component 330. The time-split component 340 then selectively performs a time-split transform, as described below. Optionally, when a decoder is employing feedback 365, the encoding component 335 then decodes to provide a reconstructed signal for auditory quality analysis by the quality measurement component 350. The encoding component 335 again transform codes (with rate-control and quantization) the input signal using the second-pass window size configuration provided by the windows configuration component 330 to produce the compressed stream 360.

The quality measurement component 350 analyzes the auditory quality of the reconstructed signal produced from transform coding using the initial or next window size configuration, so as to provide closed-loop quality measurement feedback to the windows configuration component 330. The quality measurement component analyzes the quality of each coding window, such as by measuring the noise-to-excitation ratio achieved for the coding window. Alternatively, various other quality measures (e.g., the noise-to-mask ratio) can be used to assess the quality achieved with the selected window size. Optionally, this quality measure is used by the windows configuration component 330 in its second-pass to select particular window sizes to increase for rate control, with minimal loss of quality.

Figure 8:
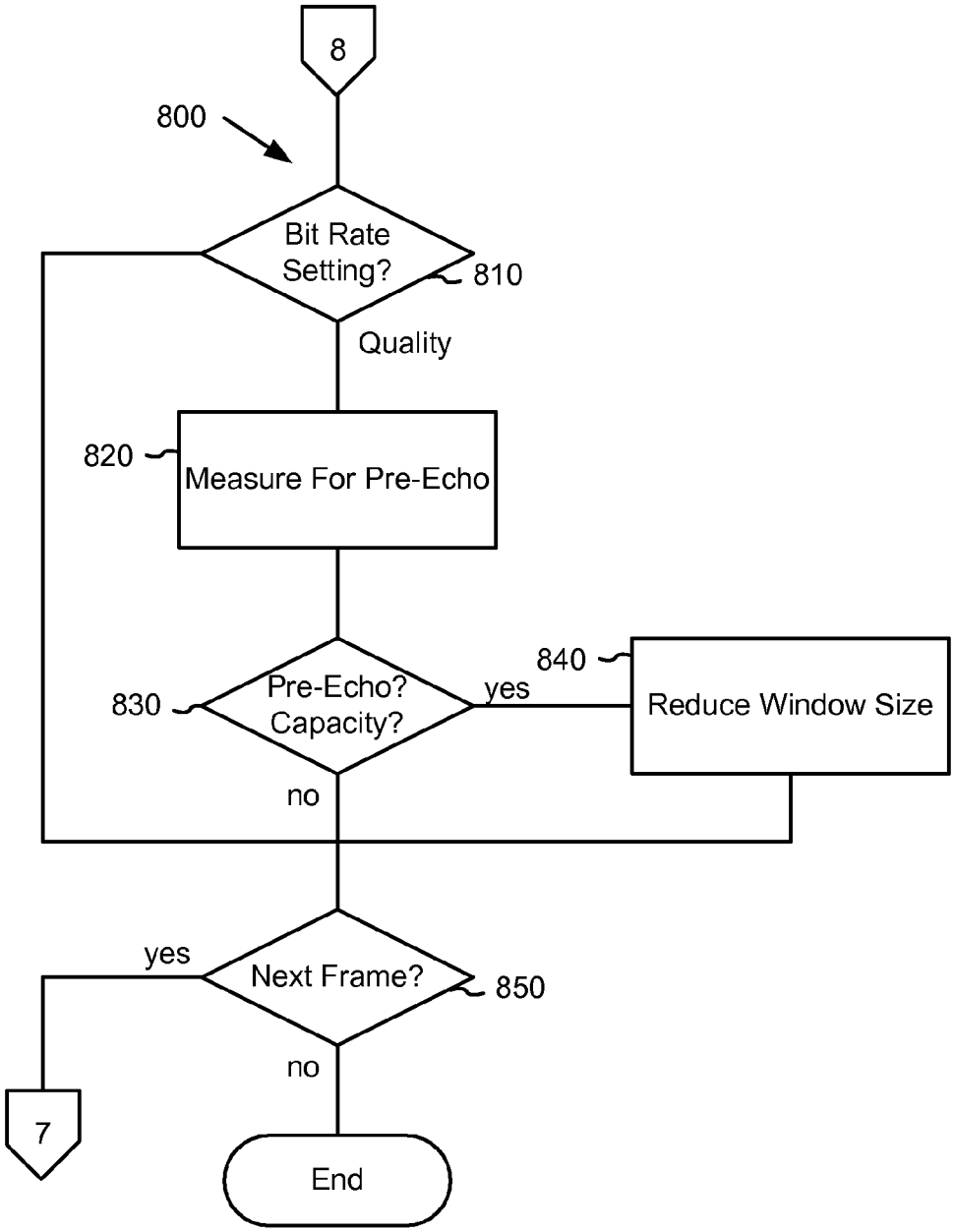
FIG. 8 (PRIOR ART)
FIG. 8 is a flow chart of an exemplary process to detect pre-echo.

The quality measurement component 350 may also use the quality analysis to detect pre-echo. An exemplary process to detect pre-echo is illustrated in FIG. 8), and described below. Results of the pre-echo detection also are fed back to the windows configuration component 330. Based on the pre-echo detection feedback, the windows configuration component 330 may further reduce window sizes (e.g., where rate-control constraints allow) to avoid pre-echo for the second-pass window configuration.

In the case of multi-channel audio encoding, the transform coder 300 in one implementation produces a common window size configuration for the multiple coding channels. In an alternative implementation for multi-channel audio encoding, the transform coder 300 separately configures transform window sizes for individual coding channels.

Exemplary Changing Signal Characteristic Detection

FIG. 4 illustrates one exemplary changing signal characteristic detection process 400 performed by the changing signal characteristic detection component 320 to detect changing signal characteristics in the input signal. As indicated at step 470, the process 470 is repeated on a frame-by-frame basis on the input signal.

The changing signal characteristic detection process 400 first band-pass filters (at first stage 410) the input signal frame. The changing signal characteristic detection process 400 uses three filters with pass bands in different audio ranges, i.e., low, middle and high-pass ranges. The filters may be elliptic filters, such as may be designed using a standard filter design tool (e.g., MATLAB), although other filter shapes alternatively can be used. The squared output of the filters represents the power of the input signal in the respective audio spectrum range at each sample. The low-pass, mid-pass and high-pass power outputs are denoted herein as $P_l(n)$, $P_m(n)$, and $P_h(n)$, where n is the sample number within the frame.

Next (at stage 420), the changing signal characteristic detection process 400 further low-pass filters (i.e., smoothes) the power outputs of the band-pass filter stage for each sample. The changing signal characteristic detection process 400 performs low-pass filtering by computing the following sums (denoted $Q_l(n)$, $Q_m(n)$ and $Q_h(n)$) of the low-pass, mid-pass and high-pass filtered power outputs at each sample n, as shown in the following equations:

$$Q_l(n) = \sum_{i=0}^{t} P_l(n-s+i)$$

$$Q_m(n) = \sum_{i=0}^{t} P_m(n-s+i)$$

$$Q_h(n) = \sum_{i=0}^{t} P_h(n-s+i)$$

where s and t are predefined constants and ($t \geqq s$). Examples of suitable values for the constants are t=288 and s=256.

The changing signal characteristic detection process 400 then (at stage 430) calculates the local power at each sample by again summing the power outputs of the three bands over a smaller interval centered at each sample, as shown by the following equations:

$$S_l(n) = \sum_{i=0}^{v} P_l(n-u+i)$$

$$S_m(n) = \sum_{i=0}^{v} P_m(n-u+i)$$

$$S_h(n) = \sum_{i=0}^{v} P_h(n-u+i)$$

where u and v are predefined constants smaller than t and s. Examples of suitable values of the constants are u=32 and v=32.

At stage 440, the changing signal characteristic detection process 400 compares the local power at each sample to the low-pass filter power output, by calculating the ratios shown in the following equations:

$$R_l(n)=S_l(n)/Q_l(n)$$

$$R_m(n)=S_m(n)/Q_m(n)$$

$$R_h(n)=S_h(n)/Q_h(n)$$

Finally, at decision stage 450 and 460, the changing signal characteristic detection process 400 determines that a changing signal characteristic exists if the ratio calculated at stage 440 exceeds predetermined thresholds, $T_l$, $T_m$, and $T_h$ for the respective bands. In other words, if any of $R_l(n)>T_l$, or $1/R_l(n)>T'_l$, or $R_m(n)>T_m$, or $1/R_m(n)>T'_m$, or $R_h(n)>T_h$, or $1/R_h(n)>T'_h$, where $T_l$, $T'_l$, $T_m$, $T'_m$, $T_h$, $T'_h$ are thresholds, then the sample location n is marked as a changing signal characteristic location. An example of suitable threshold values is in the range of 10 to 40. It is important to note that a changing signal characteristic is declared so long as there is sufficient change in energy in any of the three bands. So coding efficiency may be reduced if there are certain frequency ranges where a changing signal characteristic did not exist.

Exemplary Window Configuration

FIG. 5 shows an open-loop window configuration process 500, which is used in the window configuration component 530 to perform its first pass window configuration. Adaptive window size configuration is not required to perform time-split transforms in a transform coder, rather it is an additional feature that may be employed in some embodiments. The open-loop window configuration process 500 configures window sizes for transform coding by the encoding component 340 based on information of changing signal characteristic locations detected via the changing signal characteristic detection process 400 by the changing signal characteristic detection component 320. In the illustrated process, the window configuration component 330 selects from a number of predefined sizes, which may include a smallest size, largest size, and one or more intermediate sizes.

As indicated at step 510 in the window configuration process 500, the process 500 determines if any changing signal characteristics (CSC), such as a transient or otherwise were detected in the frame. If so, the window configuration process places windows of the smallest size over changing signal characteristic-containing regions of the frame (as indicated at 520), such that the changing signal characteristics are completely encompassed by one or more smallest size windows. Then (at 530), the process 500 fills gaps before and after the smallest size windows with one or more transition windows.

If no changing signal characteristics are detected in a frame, the window configuration process 500 configures the frame to contain a largest size window (as indicated at 540). The process 500 continues on a frame-by-frame basis as indicated at step 550.

Figure 6:
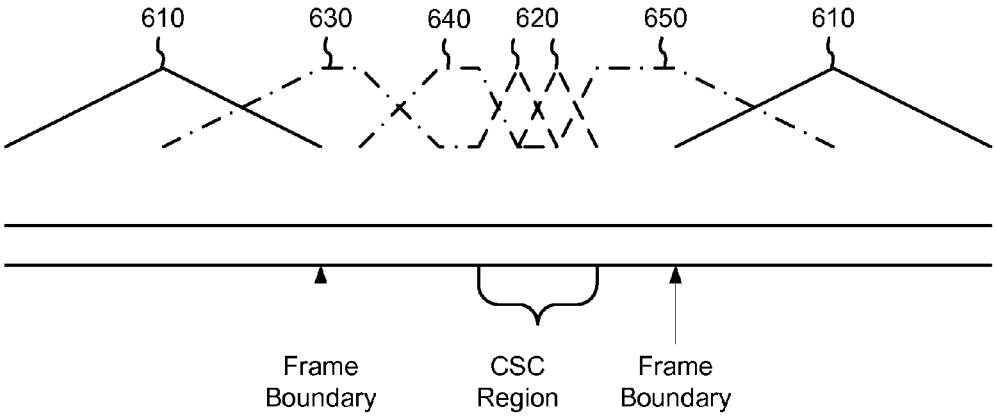
FIG. 6 (PRIOR ART)
FIG. 6 is a graph of an example window configuration produced via the process of FIG. 5.

FIG. 6 shows an example window configuration produced via the process 500. First, since no changing signal characteristic is detected in the prior frame, the process 500 places a largest size window 610 in that frame. The process 500 then places smallest size windows 620 to completely encompass changing signal characteristics detected in a transient region. The process 500 next fills a gap between the window 610 and windows 620 with intermediate size transition windows 630 and 640, and also fills a gap with the next frame window with intermediate size transition window 650. The open-loop window configuration process 500 has the advantage that the smallest size windows are placed over the changing signal characteristic region, as compared to filling a full frame.

Exemplary Quality Measurement

As discussed above, an optional quality measurement component 350 analyzes the achieved quality of audio information and feeds back the quality measurements to the window configuration component for use in adjusting window sizes. A window configuration component 350 may take two actions depending on the achieved quality of the signal. First, when the quantization noise is not acceptable, the window configuration component 350 trades the time resolution for better quantization by increasing the smallest window size. Further, when pre-echo is detected, the window configuration component splits the corresponding windows to increase time resolution, provided there are sufficient spare bits to meet bit rate constraints.

More specifically, FIGS. 7 and 8 show a quality measurement and adapted window configuration process 700. As indicated at decisions 710 and 810, a bit rate setting can be considered in the transform coder 300 (FIG. 3) in order to determine whether the process 700 takes the actions depicted for processing loops 720-750 and 820-840, respectively. More particularly, when a bit rate setting emphasizes coding efficiency (at 710), the window configuration process 700 performs processing loop 720-750. When the rate setting is for high quality (at 810), the window configuration process 700 performs processing in loop 820-840. These rate setting classes need not be mutually exclusive. In other words, there may be some rate settings in some transform coders that call for a balance of both coding efficiency and quality, such that both processing loops 720-750 and 820-840 are performed.

At a first processing step 720 in the first processing loop 720-750, the window configuration process 700 measures the achieved quality of the transform coded signal. In one implementation, the process 700 measures the achieved Noise-To-Excitation Ratio (NER) for each coding window. The NER of the coding window of the reconstructed, transform coded signal can be calculated as described in the Perceptual Audio Quality Measurement Patent Application, U.S. patent application Ser. No. 10/017,861, filed Dec. 14, 2001. Alternatively, other quality measures applicable to assessing acceptability or perceptibility of quantization noise can be used, such as noise-to-mask ration described or referenced in "Method for objective measurements of perceived audio quality," International Telecommunication Union-Recommendation Broadcasting Service (Sound) Series (ITU-R BS) 1387 (1998).

Next (at 730), the window configuration process 700 compares the quality measurement to a threshold. If the quantization noise is not acceptable, the window configuration process 700 (at 750) increases the minimum allowed window size for the frame. As an example, in one implementation, the window configuration process 700 increases the minimally allowed window size for the frame by a factor of 2 if the NER of a coding window in the frame exceeds 0.5. If the NER is greater than 1.0, the minimum allowed window size is increased by 4 times. The acceptable quantization noise threshold and the increase in minimum allowed window size are parameters that can be varied in alternative implementations.

As indicated at decision 740, the window configuration process 700 also can increase the window size when the quantization noise is acceptable, but the rate control buffer of the transform coder is nearly full (e.g., 95% or other like amount depending on size of buffer, variance in bit rate, and other factors).

In an alternative implementation of the process 700, the window configuration process 700 at processing step 720 uses a delayed quality measurement. As examples, the quality of coding of the preceding frame or average quality of previous few frames could be used to determine the minimum allowed window size for the current frame. In one implementation, the final NER obtained at the preceding frame is used to determine the minimum window size (at 750) used in the configuration process 500. Such use of a delayed quality measurement reduces the implementation complexity, albeit with some sacrifice in accuracy.

In the second processing loop 820-840, the window configuration process 700 also measures to detect pre-echo in the frame. For pre-echo detection, the process 700 divides the frame of the reconstructed, transform coded signal into a set of very small windows (smaller than the smallest coding window), and calculates the quality measure (e.g., the NMR or NER) for each of the very small windows. This produces a quality measure vector (e.g., a vector of NMR or NER values). The process 700 also calculates a global achieved quality measure for the frame (e.g., the NMR or NER of the frame). The process 700 determines that pre-echo exists if any component of the vector is significantly higher (e.g., by a threshold factor) than the achieved global quality measure for the frame. Suitable threshold factor is in the range 4 to 10. Alternative implementations can use other values for the threshold.

In the case where pre-echo is detected and there is sufficient spare coding capacity (e.g., rate control buffer not full or nearly full), the window configuration process 700 (at 840) adjusts the window configuration in the frame to further reduce the window size. In one implementation, the process 700 decomposes the frame into a series of smallest size windows (e.g., the size of window 620 of FIG. 6). Alternatively, the process 700 locally reduces the size of the first-pass coding windows in which pre-echo is detected, rather than reducing all windows in the frame to the smallest size. As indicated at 850, the window configuration process 700 then continues on a frame-by-frame basis. However, alternative implementations need not perform the window configuration on a frame basis.

Exemplary Selective Time-Splitting

In order to determine whether to apply time-splitting, the data is programmatically examined for certain characteristics (see e.g., FIG. 3, 320). In another example (not shown), after encoding (335), the results are examined for pre or post echo or other artifacts, such as changing signal characteristics (320, 350). Pre-echo or post-echo are common characteristics of using a large time window when a small one is needed.

Optionally, an input signal is coded into a baseband and then the baseband shape is examined to determine similar shapes in an extended band. A similar shape in the baseband provides a shape model for similar shapes being coded at other frequencies. The baseband shapes provide synthetic models or codewords used to code the higher frequencies. The coded baseband is used to create an extended band or enhanced layer. In one such example, a time envelope is created resulting from reconstructing with the enhancement layer and comparing with the original time envelope. If there is a big difference, in the original versus reconstructed signal, then a determination is made to time-split at or near sub-bands where signal quality is compromised between the enhanced and original signal.

A changing signal characteristic detection routine (320) should also look for large energy differences in a high band which is being coded in the enhancement layer. If there are significant energy differences only present in the high band (such as, those being coded with enhancement in the extended band), and not in frequencies which are being coded with the baseband codec, then this is the ideal case when a large window size should be used for the baseband. Then, time-splitting can be used for the enhancement to get better time resolution in high frequencies without requiring a shorter window in the baseband. This will give the best compression efficiency without causing undesirable artifacts due to poor time resolution at high frequencies.

However, there might be cases when artifacts remain even after performing the time-split transform. Although the time-split results in energy compaction in time domain, it does not always work as well as truly using a smaller time window (e.g., see smaller windows in FIG. 9, 908). In such a case, the results from time-split can be used as feedback before deciding to modify the window size. This means that if the high band is not able to be coded well (e.g., acceptable artifacts), then simply reduce the sub-frame size being used (e.g., FIG. 3, 365).

Additionally, it will be apparent that any similarly suitable and invertible transform can be used to alter or dampen the artifacts created by spreading the error across the spectrum. Here, since the MLT is an orthogonal transform, applying a orthogonal transform keeps the overall transform still orthogonal. The effect it has is in modifying the basis functions.

Exemplary Overlapping Windows

When utilizing an MLT (e.g., MDCT), overlapping windows are used to segment the data into blocks. For each of these overlapping blocks, a DCT transform is performed on the data in the window. Optionally, plural overlapping window sizes can be used. The windows sizes can be applied based upon signal characteristics, where small windows are used at changing signal characteristics (e.g., where signal characteristics such as energy change), and larger windows are used elsewhere to obtain better compression efficiency.

Figure 9:
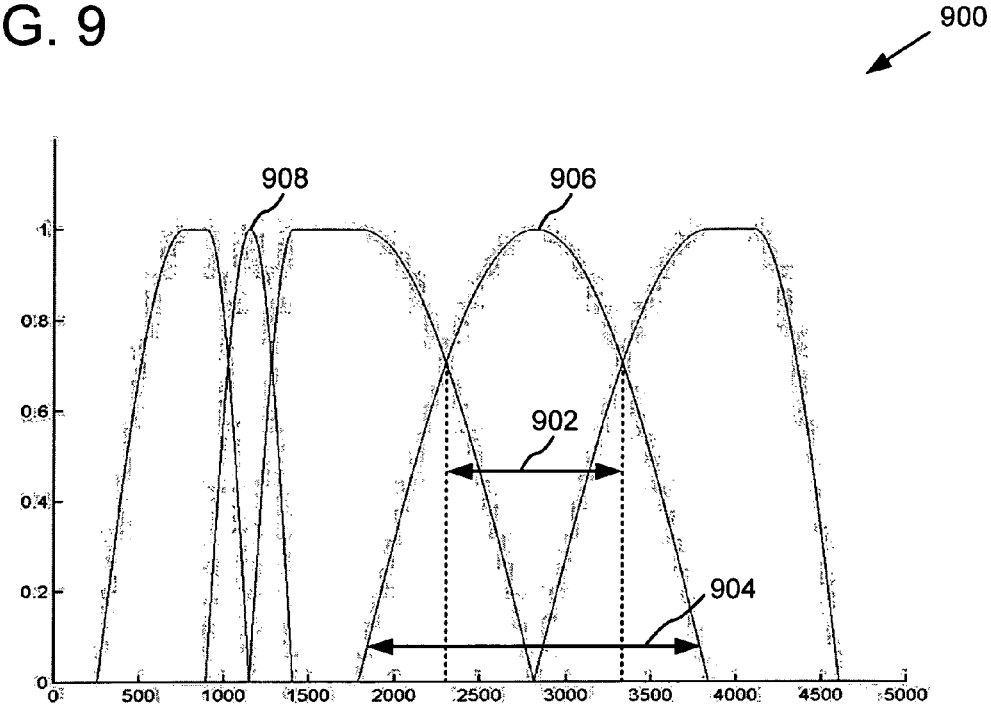
FIG. 9 is a graph representing exemplary overlapping windows covering segmentation blocks.

FIG. 9 is a graph representing exemplary overlapping windows covering segmentation blocks. As shown in 900, the segmentation blocks 902 of signal data are transformed from the time domain to the transform domain (e.g., frequency domain) using overlapping windows 904. For each window with M spectral samples, an overlapping window of size 2M (50% overlap on each side) is used to transform the data. However, the coefficients in the 2M window may not all be nonzero coefficients, as this depends on the neighboring block sizes. If either of the two neighboring blocks and corresponding windows are smaller than M, then at least some of the 2M window coefficients are zero.

For each block (or sub-frame), an invertible transform is computed transforming input audio samples from the time domain to the transform domain (e.g., a DCT or other known transform domains). The M resulting MLT coefficients from the 2M window are used for each M-size sub-frame. The overlap ensures that this 2M-to-M transformation can be inverted without any loss. Of course, there will be some loss during quantization. The 2M-to-M transformation can be represented as a projection of the 2M-dimensional signal vector onto the basis vectors. The shape of the M basis vectors are dependent on the window shape. Neither overlapping windows nor any particular segmentation methodology is required to time-split adjacent coefficients. However, if overlapping windows are used, the basis vectors typically vary based on the current sub-frame size, the previous sub-frame size, and the next sub-frame size. If the DCT cosine basis vectors (e.g., basis vectors) are to provide good time resolution, then they should have localized support in the time domain. If the basis vectors are viewed as a function of time index, then they should have most of their energy concentrated around the center of the frame.

Exemplary Segmentation

Consider an example, with a 32-dimensional vector (e.g., 32 input samples, such as audio/video), that has been split into 4 sub-frames of size 8 (e.g., a segmentation of [8 8 8 8]). Often, the frame would be larger (e.g., 2048 samples) and the segmentation (e.g., sub-frame sizes) would be larger and possibly variable in size within the frame (e.g., [8, 8, 64, 64, 32, 128, 128]). As will be discussed, time-splitting transform can be selectively performed without regard to sub-frame size and whether or not segmentation size is variable. However, the 32-dimensional vector provides an example for the following discussion, with the understanding that the described technology is not limited to any such configurations.

Figure 10:
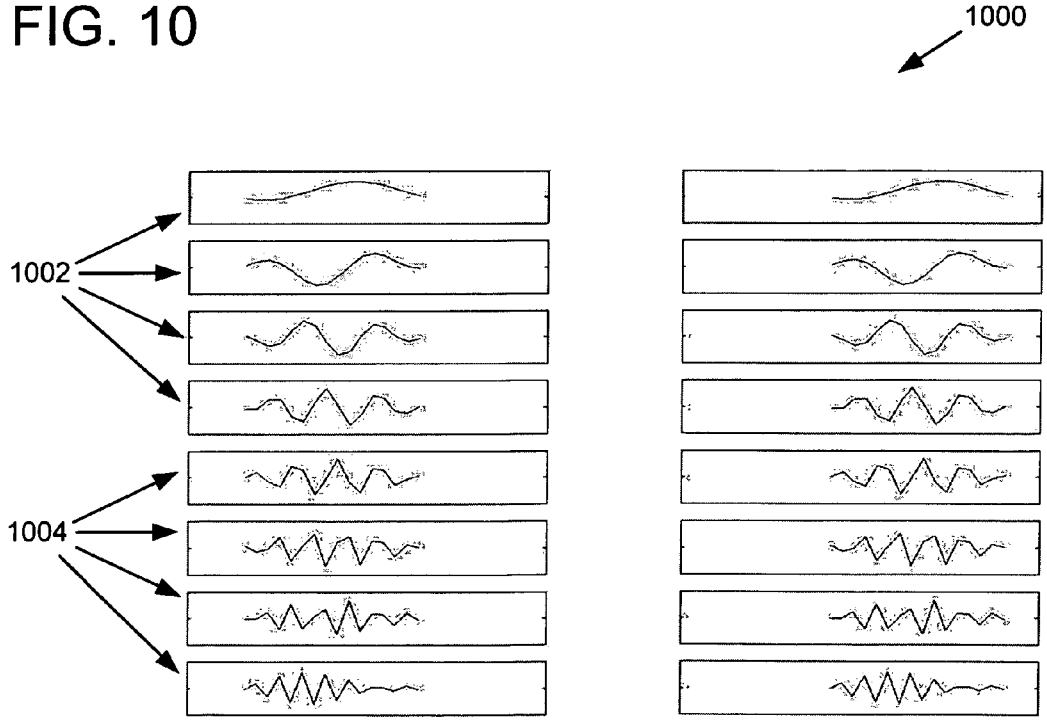
FIG. 10 is a graph of the basis vectors that contribute to the MLT coefficients corresponding to the middle two sub-frames.

FIG. 10 is a graph of the basis vectors that contribute to the MLT coefficients corresponding to the middle two sub-frames. For example, assume that the 16 basis vectors 1000, each with time span 16, contribute to the MLT coefficients from the middle two sub-frames (e.g., in bold [8 8 8 8]). This illustrates 1000 that each sub-frame has a certain time span, and the time resolution is related to the time span. Similarly, if the 32 dimensional vector is segmented into 8 sub-frames of size 4, then the segmentation would be [4 4 4 4 4 4 4 4].

Figure 11:
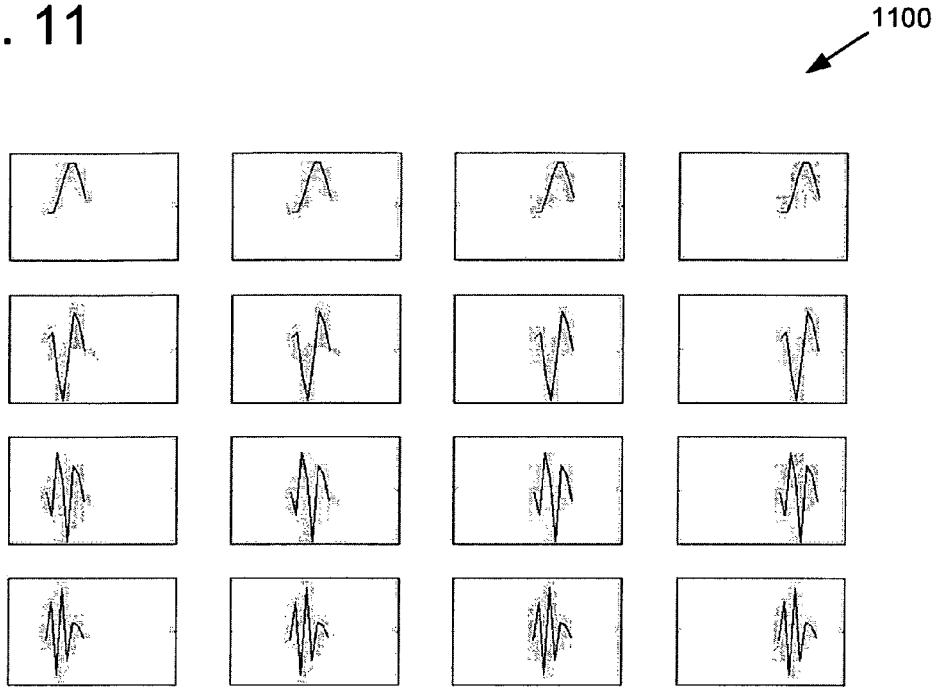
FIG. 11 is a graph of the basis vectors that contribute to the MLT coefficients corresponding to the middle four sub-frames with smaller sized segmentation.

FIG. 11 is a graph of the basis vectors that contribute to the MLT coefficients corresponding to the middle four sub-frames with smaller sized segmentation. For example, the basis vectors 1100 corresponding to the MLT coefficients for the middle 4 sub-frames (e.g., [4 4 4 4 4 4 4 4]), are the same differently grouped coefficients as the middle 2 sub-bands in the sub-band size 8 case. The basis vectors 1100 each have a time-span of 8. The graph 1100, shows the basis vectors as a time frequency grid, with the time axis running along the columns, and the frequency axis being the rows.

From these two figures 1000, 1100, it is apparent that sub-frame size relates to time resolution. Now, suppose that the time resolution is sufficient at lower frequencies (e.g., 1002), but not at higher frequencies (e.g., 1004). Note that in FIG. 10, the top row is the lowest frequency basis vector, and each row below it, in order, increases in frequency with the bottom row being the highest frequency. For example, if there is a changing signal characteristic in a high frequency, it may be beneficial to provide better time resolution to reduce artifacts introduced by the changing signal characteristic. However, it may only be the high frequency that has a changing signal characteristic, and thus the time resolution in a lower frequency is adequate 1002. Also, the time resolution needed for a particular frequency range is also dependent on the coding method being used to code that frequency range. For example, when coding a particular frequency range as an extended band using "Efficient coding of digital media spectral data using wide-sense perceptual similarity", then better time resolution might be needed than if coding it as a traditional baseband coding scheme.

A time-splitting transform is selectively applied at adjacent coefficients where better time resolution is desired. Instead of just using the coefficients obtained from the MLT, a post block transform on a subset of the M spectral coefficients is performed, such as a time-splitting transform. By imposing constraints on the structure of the transform, better time resolution is selectively obtained for some frequency coefficients, but not others.

Figure 12:
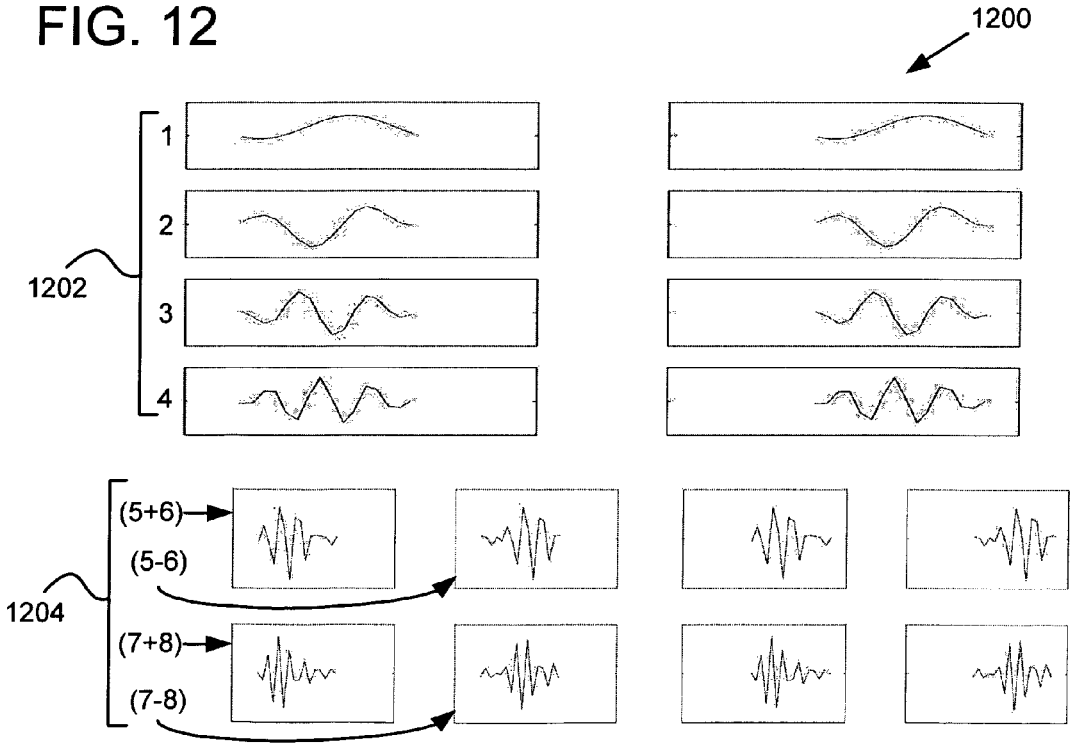
FIG. 12 is a graph representing how time-splitting combines adjacent coefficients.

FIG. 12 is a graph representing how time-splitting combines adjacent coefficients. In this example, the combined coefficients are high frequencies coefficients. As shown, the basis vectors 1-4 remain unchanged 1202, but basis vectors 5±6, and 7±8 have been selected for a time-split 1204. Thus, basis vectors 5 and 6 have been added to and subtracted from one another to provide a time-split transform. Basis vectors 7 and 8 have been added to and subtracted from one another to provide a time-split transform. In this example, two sets of basis vectors have been transformed to represent time-splitting, but either could be used alone, such as just 5±6, or 7±8. Additionally, the 8 rows of adjacent basis vectors could provide various other selectable time-splitting transforms, such as one or more of the following row transforms: 1±2, 2±3, 3±4, 4±5, 5±6, 6±7, or 7±8. Thus, any basis vector can be time-split with any adjacent basis vector. The graph 1200 represents how a 5+6, 5−6 and 7+8, 7−8 time-split transform relates to the basis vectors.

A selective application of time-splitting is applied to the high frequency coefficients, for example, using a simple transform of the form (a+b)/2, (a−b)/2, where 'a' and 'b' are two adjacent coefficients. Notice that FIG. 11 provides rows of four frequency patterns and columns of four (shifting) time patterns. Further, FIG. 10 provides rows of eight frequency patterns and columns of two time patterns. In one respect, time splitting as shown in FIG. 12 provides better time resolution of FIG. 11 for a sample selection of high frequencies, while maintaining the better frequency resolution for low frequencies of FIG. 10.

Figures 13, 14:
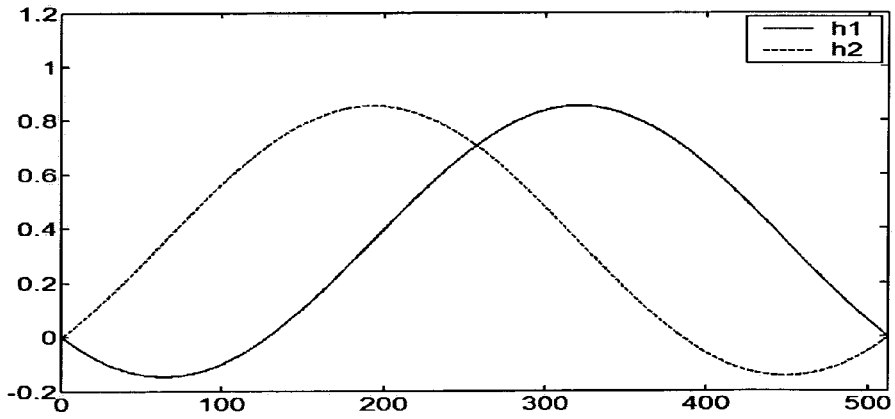
FIG. 13 is a matrix representing an exemplary time-split transform of FIG. 12.
FIG. 14 is a graph of two new exemplary time-split window functions.

FIG. 13 is a matrix representing an exemplary time-splitting transform of FIG. 12. The time-splitting transform represented by FIG. 12, is applied after the time domain to frequency domain (e.g., DCT) transform, in this example using the matrix 1300. By combining (±) basis functions from different frequencies, frequency resolution is reduced, and time resolution is gained in the process. Better time resolution is useful to more closely model rapidly changing data from a transient area. For example, using the time-split transform on the example of sub-frame size 8, the high frequency basis functions from FIG. 11, are effectively incorporated into the basis vectors shown in FIG. 12. The $1/\sqrt{2}$ scaling factor can be optionally applied, as shown in FIG. 13, to maintain proper normalization of the time-split basis functions (such as those in FIG. 12, 1204). Alternatively, that normalization factor can be incorporated in the quantization steps of the encoding component 335. Also, other values for the normalization factor can be used, if it is deemed appropriate, e.g. by the quality measurement 350.

As can be seen, the post block transform (e.g., time-split transform) results in time separation. Although the time span of the resulting basis vectors is the same as before, the energy concentration has been more localized. This is better understood in view of the following analysis.

Exemplary Analysis of Time-splitting

The MLT coefficients for a sub-frame of size M are defined as:

$$X[k] = \sqrt{\frac{2}{M}} \sum_{n=0}^{2M-1} x[n]h[n]\cos\left[\left(n + \frac{M+1}{2}\right)\left(k + \frac{1}{2}\right)\frac{\pi}{M}\right], \quad k = 0, 1, \ldots, M-1, \qquad \text{Equation 1}$$

where h[n] is the window. The time index n=0 is defined to be M/2 samples to the left of the start of the current sub-frame, so that x[M/2] is the start of the current sub-frame. Notice that the equation provides an optional overlapping window sizes (e.g., 2M). Starting with X[k]+X[k+1], and then using the known relationship of cos(a)+cos(b)=2 cos((a−b)/2)cos((a+b)/2), the following is obtained:

$$X[k] + X[k+1] = 2\sqrt{\frac{2}{M}} \sum_{n=0}^{2M-1} x[n]h[n]\cos\left[\left(n + \frac{M+1}{2}\right)(k+1)\frac{\pi}{M}\right] \cos\left[\left(n + \frac{M+1}{2}\right)\frac{\pi}{2M}\right] \qquad \text{Equation 2}$$

Similarly, staring with X[k]-X[k+1], and using the known relationship of cos(a)−cos(b)=−2 sin((a−b)/2)sin((a+b)/2), the following is obtained:

$$X[k] - X[k+1] = 2\sqrt{\frac{2}{M}} \sum_{n=0}^{2M-1} x[n]h[n] \sin\left[\left(n + \frac{M+1}{2}\right)\frac{\pi}{2M}\right]\sin\left[\left(n + \frac{M+1}{2}\right)(k+1)\frac{\pi}{M}\right] \qquad \text{Equation 3}$$

Equations 2 and 3 can be rewritten as equations 4 and 5, respectively, as follows, $$X[k] + X[k+1] = 2\sqrt{\frac{2}{M}} \sum_{n=0}^{2M-1} x[n]h_1[n]\cos\left[\left(n + \frac{M+1}{2}\right)(k+1)\frac{\pi}{M}\right] \qquad \text{Equation 4}$$

$$X[k] - X[k+1] = 2\sqrt{\frac{2}{M}} \sum_{n=0}^{2M-1} x[n]h_2[n]\sin\left[\left(n + \frac{M+1}{2}\right)(k+1)\frac{\pi}{M}\right] \qquad \text{Equation 5}$$

such that $h_1[n]$ and $h_2[n]$ are defined as shown in equations 7 and 8.

$$h_1[n] = h[n]\cos\left[\left(n + \frac{M+1}{2}\right)\frac{\pi}{2M}\right]$$

$$h_2[n] = h[n]\sin\left[\left(n + \frac{M+1}{2}\right)\frac{\pi}{2M}\right]$$

Equation 7 and 8

Thus, the two original frequency-domain coefficients X[k] and X[k+1], which corresponded to the modulating frequencies (k+1/2)π/M and (k+3/2)π/M, respectively, are replaced. By replacing those coefficients with the following coefficients (X[k]+X[k+1]) and (X[k]−X[k+1]), there are two new frequency-domain coefficients that now correspond to the same frequency (k+1)π/M (but with a 90 degree phase shift, since one is modulated by a cosine function and the other by a sine function), but modulated by different windows $h_1[n]$ and $h_2[n]$, respectively.

FIG. 14 is a graph of these two new time-split window functions. In this example, the graph is of the two new window functions of Equations 7 and 8 plotted with M=256. The graph of the two equations shows why the time separation occurs. Assuming the neighbor windows have the same window shape, the standard sub-frame window shape 906 used in FIG. 9, is represented as follows, $$h[n] = \sin\left[\left(n + \frac{1}{2}\right)\frac{\pi}{2M}\right], \quad n = 0, 1, \ldots, 2M-1.$$

Equation 9

A sub-band merging approach was first described in R. Cox, "The Design of Uniformly and Nonuniformly Spaced Pseudoquadrature Mirror Filters" IEEE Transactions on Acoustics, Speech, and Signal Processing, vol. 34, pp. 1090-1096, October 1986, and was applied to the MLT in H. S. Malvar, "Enhancing the Performance of Sub-Band Audio Coders for Speech Signals", Proc. 1998 IEEE International Symposium on Circuits and Systems, vol. 5, pp. 98-101, June 1998 ("Malvar"). Contrary to the decomposition in Malvar, where all high-frequencies (after a predetermined value of k) are pairwise split according to the construction above, a time-splitting transform is performed only on selected pairs of coefficients, according to a selection criteria. Thus, fixed time-splitting is replaced by selective time-splitting based upon the characteristics of the input signal or derivations thereof. In practice one can combine more then two sub-bands, but the quality of time-splitting suffers that is, time selectivity will not be as good. See e.g., O. A. Niamut and R. Heusdens, "Sub-band Merging in Cosine-modulated Filter Banks", IEEE Signal Processing Letters, vol. 10, pp. 111-114, April 2003, and see ADAPTIVE WINDOW-SIZE SELECTION IN TRANSFORM CODING, U.S. patent application Ser. No. 10/020,708 filed Dec. 14, 2001.

Exemplary Spectral Coefficients

Figure 15:
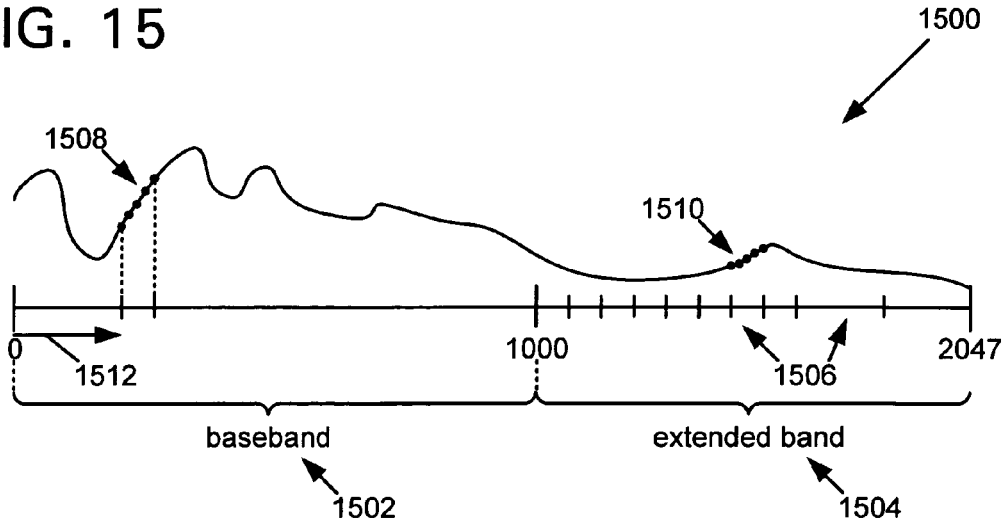
FIG. 15 is a graph representing an exemplary set of spectral coefficients.

FIG. 15 is a graph representing a set of spectral coefficients. For example, the coefficients (1500) are an output of a sub-band transform or an overlapped orthogonal transform such as MDCT or MLT, to produce a set of spectral coefficients for each input block of the audio signal.

In one example, a portion of the output of the transform called the baseband. (1502) is encoded by the baseband coder. Then the extended band (1504) is divided into sub-bands of homogeneous or varied sizes (1506). Shapes in the baseband (1508) (e.g., shapes as represented by a series of coefficients) are compared to shapes in the extended band (1510), and an offset (1512) representing a similar shape in the baseband is used to encode a shape (e.g., sub-band) in the extended band so that fewer bits need to be encoded and sent to the decoder.

Sub-bands may vary from subframe to subframe. Similarly, a baseband (1502) size may vary, and a resulting extended band (1504) may vary in size based on the baseband. The extended band may be divided into various and multiple size sub-band sizes (1506).

In this example, a baseband segment is used to identify a codeword for a particular shape (1508) to simulate a sub-band in the extended band (1510) transformed to create other shapes (e.g., other series of coefficients) that might more closely provide a model for the vector (1510) being coded. Thus, plural segments in the baseband are used as potential models to code data in the extended band. Instead of sending the actual coefficients (1510) in a sub-band in the extended band an identifier such as a motion vector offset (1512), is sent to the encoder to represent the data for the extended band. However, sometimes there are no close matches in the baseband for data being modeled in a sub-band. This may be because of low bitrate constraints that allow a limited size baseband. The baseband size (1502) as relative to the extended band may vary based on computing resources such as time, output device, or bandwidth.

Exemplary Transform Matrices

One channel of audio/video is split into time segments as shown in FIG. 9, and for each segment a time domain to frequency domain transformation is provided, optionally with an overlapping windows. For example, assume a overlapping window is applied to a time segment followed by a DCT. A DCT produces coefficients which are linear projections of the windowed time segment onto basis vectors. The inverse frequency to time domain transformation involves taking a linear combination of the basis vectors where the basis vectors are weighted by the DCT coefficients. Thus any noise (e.g. quantization noise) or other significant energy changes in the DCT coefficients will be spread across time due to the support of the basis vectors. For example, if the basis vectors have compact support (e.g. the energy is localized in time), then there will be less temporal smearing of the quantization noise or other changes to the DCT coefficients. One way to do this is to break a time window into smaller windows. Since the basis vectors have a support of 2M samples, the smaller the M, the smaller the support. Another way is to selectively use a time-split transform in frequency ranges where changing signal characteristics are detected, or in frequency ranges where it is needed because of the coding method being used. A time splitting transform does not reduce the support of the basis vectors, but instead compacts the energy into different regions of the time segment. Therefore there will be some energy over the entire 2M samples of the basis vector, but a large portion of it will be concentrated around a central point.

Figure 16:
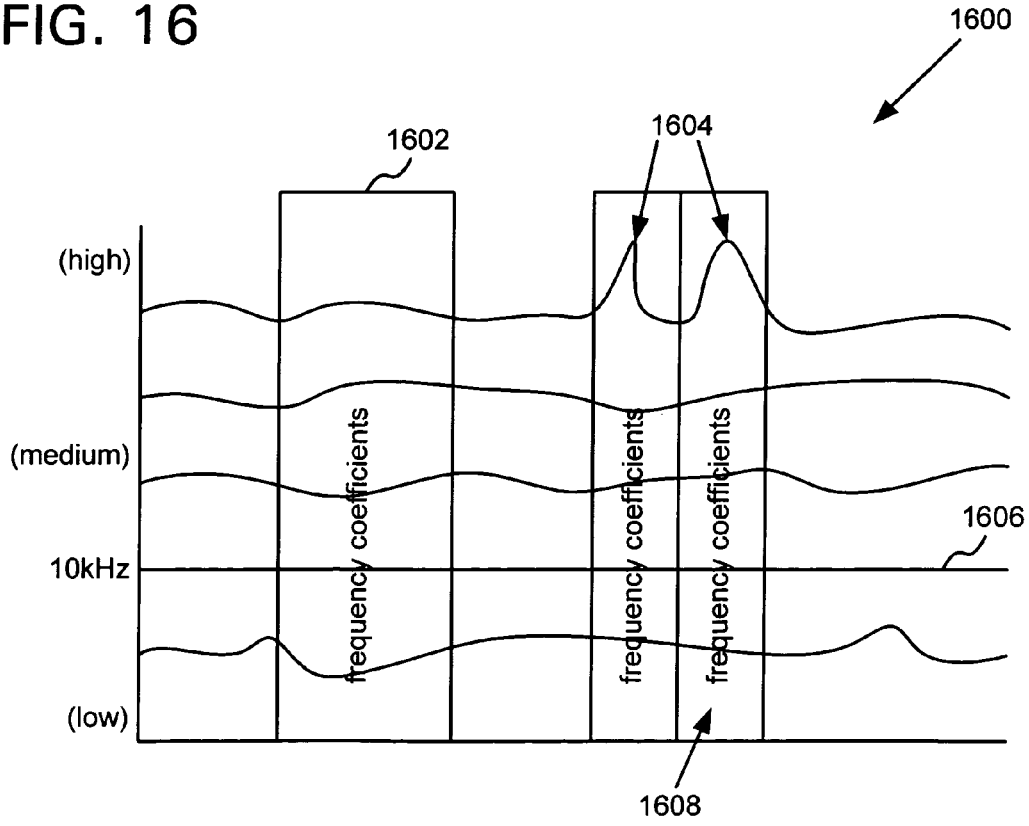
FIG. 16 is a graph of an exemplary time-frequency plot of selected frequency coefficients.

FIG. 16 is a graph of an exemplary time domain representation of frequency coefficients. For example, if a signal at a frequency changes dramatically (1604), preferably a window size that is adequate for a more stable signal (1602) should be divided into smaller windows to reduce echo. But in the context of frequency extrapolation using a baseband and extended band codec, not all windows can be sub-divided. In one example, a baseband window represented frequency information coding up to 10-kilohertz (kHz) (1606), and under 10 kHz, there is generally no need to break windows up because the sound is quite uniform. However, above 10 kHz, for example to 20 kHz, there might be a distinct sound such as a metallic sound that would show up in the 20 kHz frequency range. For this distinct sound in a determined frequency, a time-split is possibly performed to provide better time resolution. Thus, one or more frequencies within a larger segment are selectively time split. A larger window is used for the base transform but a time split achieves better time resolution for selected frequencies within the larger window.

As shown in FIG. 16, a time domain may be divided into Low, Medium or High Frequency (e.g., L, M, H, etc). Other resolutions may be used for examining inputs for data variance requiring time-split or window adaptation. It can be any of the bands H, L, M, that need better time resolution. Frequency coefficients (1608) are represented in the time domain as x[n], for n=0 . . . 2M-1. The idea is to identify any segment that could beneficially use better time resolution and then apply a transformation that is going to add and subtract two coefficients together to alter the basis vector support. Any linear transform can be described as a matrix multiplication; however, they are often implemented in a more efficient way (e.g., Fast Fourier Transform).

Figure 17:
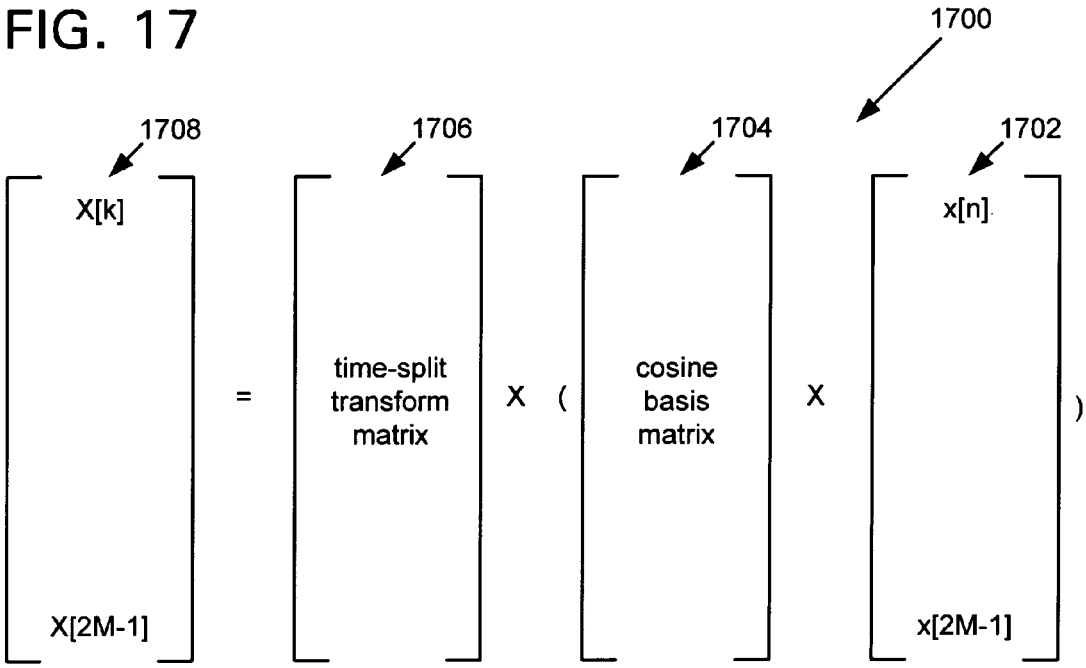
FIG. 17 is a diagram representing a linear transformation of a time domain vector into a transform domain vector including a time-split transform matrix of FIG. 13.

FIG. 17 is a diagram representing a linear transformation of a time domain vector into a frequency domain vector including a time-split transform matrix of FIG. 13. For example, a vector from the time domain (1608, 1702) is multiplied by a cosine basis matrix (1704) and a time split matrix (1706) to create a transform domain vector (1708) (e.g., frequency domain vector). The matrix 1704 contains the coefficients of the operator corresponding to the cascade combination of the signal-domain window and a DCT (of type IV), such as the MLT. Thus, the number of coefficients in the signal x[n] in the time domain is 2M, and the number of transform-domain (or frequency-domain) coefficients X[k] is M, indexed from 0 to M-1. Each element in the cosine matrix is given by Equation 9 above except for selected frequencies, which are represented selectively in the time-split-matrix by Equations 7 and 8 above.

Thus, at the decoder, when the frequency domain coefficients X[k] are transformed back to the time domain, each vector 1708 is multiplied by similar orthogonal matrices. The selected frequencies within the basis vectors 1704, are effectively multiplied by the basis vectors show in FIG. 14, thereby a changing signal characteristic in the input signal due to the larger window, is not spread throughout the selected frequencies because the time-split reduces the energy achieving a reduced or zero value. This modulated cosine is shifted a little bit in frequency, and creates a shape that reduces an error such as an echo. In this example, this result is achieved by multiplying by a second time-split transform matrix 1706, that effectively combine two adjacent coefficients.

As shown in FIG. 13, at whatever frequency region time-split is desirable, a 2×2 block is inserted (1302) into the time-split matrix. For example, two adjacent basis vectors can be combined 1302, 1304, as shown in FIG. 13. However in practice, combining more than two sets has not been effective.

The time-split transform should be done prior to quantization, but after the first transform 1704. For example, a time split transform 1706 could also be applied before or after the channel transform 120, but before quantization 150 and before the weighter 140. A 2×2 block can be place along the diagonal selectivity (as shown in FIG. 13) in order to obtain better time resolution. The transform could also be placed in a 3×3 block, 4×4 block, but the results have not proven as successful as a 2×2 block. Additionally, 2×2 blocks can be placed in various positions and the results of each position is compared upon reconstruction to determine a best placement. For example, the blocks can be transformed one way, then other ways, and the best results are selected for final coding. In another example, frequency regions for time-split transform are dynamically selected for frequency regions or for multiple frequency regions via some form of energy change detection. The results are compared, and for each eligible 2×2 block position, a bit is set to indicate whether the time-split transform is on or off. Intuitively, a transform is more likely to apply to high energy blocks since they often spread more energy.

A time-split transform is a selectively applied sum and difference of adjacent coefficients. For example, a time-split transform may also be called a selectively applied sum-difference of adjacent coefficient orthogonal transform (e.g., a SASDACO transform). Additionally, the coder signals the decoder in an output stream, where to orthogonally apply the inverse transform. For example, a side-information bit for each frequency pair signals where to apply the time-splitting SASDACO transform, and eligible blocks may be anywhere along the diagonal (e.g., two examples in FIG. 13, 1302, 1304) or only in the enhanced frequency (1504).

Of course, a sum-difference orthogonal transform 2×2 block is not limited to the 2×2 block shown in FIG. 13, 1302. For example, a transform coder could utilize any orthogonal sum-difference transform with similar transformational properties. In one such example, a orthogonal sum-difference transform on adjacent coefficients results in transforming a vector of coefficients in the transform domain as if they were multiplied by an identity matrix with at least one 2×2 block along a diagonal of the matrix, where the at least one 2×2 block comprises orthogonally transformational properties substantially similar to one of the following 2×2 blocks:

$$c*\begin{pmatrix} 1 & 1 \\ 1 & -1 \end{pmatrix}$$

$$c*\begin{pmatrix} 1 & 1 \\ -1 & 1 \end{pmatrix}$$

where c is a scale factor selected to vary the properties of the transform.

In one example, an extended portion 1504 of a sub-frame is signaled (e.g., a bit) as with or without time-split. A signaled sub-frame, may further signal a sub-band 706 as time-split, and signal blocks to perform a SASDACO transform. In one such example, a signaled block implicitly indicates applying a SASDACO transform to the other sub-bands in the sub-frame. In another example, a signal(s) is provided for each sub-band 706. A pre-echo/post decisions can be used to decide where to apply the time-split transform. A changing signal characteristic detection component may also be used to break a signal up into frequency ranges, such as high, medium, and low. For these distinctions, the transform coder determines whether there is a change in energy and applies a SASDACO transform accordingly.

Exemplary Additional Features

Thus, a block transform (e.g., time-split transform) is used after MLT decomposition to selectively get better time resolution for only some frequency components. This is useful when larger time windows can be used to get better compression efficiency, for example with low, medium, or frequency coefficients, and still provide better time resolution only where needed. A decision is used to select where to perform time-split, by programmatically examining characteristics of the spectral data. For example, examining a time envelope, energy change, changing signal characteristic detection, pre-echo, or post-echo. A decision where to perform time-split may instead be made by programmatically examining characteristics of changing signal characteristic detection. In another example, modification (reduction) of sub-frame size for base coding is made by programmatically examining the output of enhancement layer coding. These various ways of making a decision of where to make a time-split transform, may also be used to determine in a second pass at coding, where to vary window size.

Exemplary Computing Environment

Figure 18:
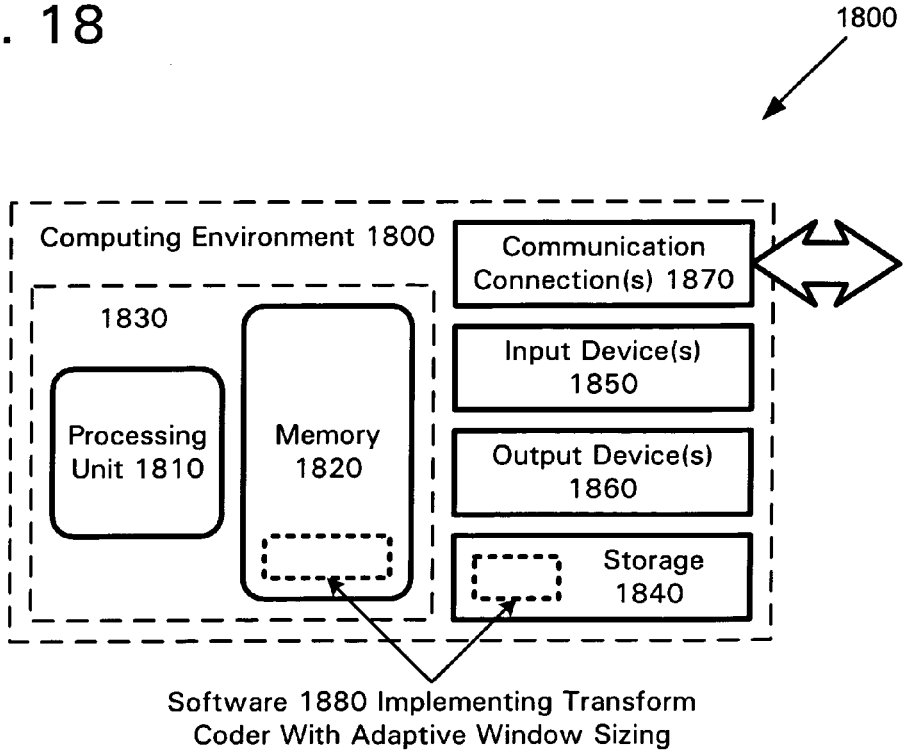
FIG. 18 illustrates a generalized example of a suitable computing environment in which the illustrative embodiment may be implemented.

FIG. 18 illustrates a generalized example of a suitable computing environment (1800) in which the illustrative embodiment may be implemented. The computing environment (1800) is not intended to suggest any limitation as to scope of use or functionality of the invention, as the present invention may be implemented in diverse general-purpose or special-purpose computing environments.

With reference to FIG. 18, the computing environment (1800) includes at least one processing unit (1810) and memory (1820). In FIG. 18, this most basic configuration (1830) is included within a dashed line. The processing unit (1810) executes computer-executable instructions and may be a real or a virtual processor. In a multi-processing system, multiple processing units execute computer-executable instructions to increase processing power. The memory (1820) may be volatile memory (e.g., registers, cache, RAM), non-volatile memory (e.g., ROM, EEPROM, flash memory, etc.), or some combination of the two. The memory (1820) stores software (1880) implementing an audio encoder.

A computing environment may have additional features. For example, the computing environment (1800) includes storage (1840), one or more input devices (1850), one or more output devices (1860), and one or more communication connections (1870). An interconnection mechanism (not shown) such as a bus, controller, or network interconnects the components of the computing environment (1800). Typically, operating system software (not shown) provides an operating environment for other software executing in the computing environment (1800), and coordinates activities of the components of the computing environment (1800).

The storage (1840) may be removable or non-removable, and includes magnetic disks, magnetic tapes or cassettes, CD-ROMs, CD-RWs, DVDs, or any other medium which can be used to store information and which can be accessed within the computing environment (1800). The storage (1840) stores instructions for the software (1880) implementing the audio encoder.

The input device(s) (1850) may be a touch input device such as a keyboard, mouse, pen, or trackball, a voice input device, a scanning device, or another device that provides input to the computing environment (1800). For audio, the input device(s) (1850) may be a sound card or similar device that accepts audio input in analog or digital form. The output device(s) (1860) may be a display, printer, speaker, or another device that provides output from the computing environment (1800).

The communication connection(s) (1870) enable communication over a communication medium to another computing entity. The communication medium conveys information such as computer-executable instructions, compressed audio or video information, or other data in a modulated data signal. A modulated data signal is a signal that has one or more of its characteristics set or changed in such a manner as to encode information in the signal. By way of example, and not limitation, communication media include wired or wireless techniques implemented with an electrical, optical, RF, infrared, acoustic, or other carrier.

The invention can be described in the general context of computer-readable media. Computer-readable media are any available media that can be accessed within a computing environment. By way of example, and not limitation, with the computing environment (1800), computer-readable media include memory (1820), storage (1840), communication media, and combinations of any of the above.

The invention can be described in the general context of computer-executable instructions, such as those included in program modules, being executed in a computing environment on a target real or virtual processor. Generally, program modules include routines, programs, libraries, objects, classes, components, data structures, etc. that perform particular tasks or implement particular abstract data types. The functionality of the program modules may be combined or split between program modules as desired in various embodiments. Computer-executable instructions for program modules may be executed within a local or distributed computing environment.

For the sake of presentation, the detailed description uses terms like "determine," "get," "adjust," and "apply" to describe computer operations in a computing environment. These terms are high-level abstractions for operations performed by a computer, and should not be confused with acts performed by a human being. The actual computer operations corresponding to these terms vary depending on implementation.

Having described and illustrated the principles of our invention with reference to an illustrative embodiment, it will be recognized that the illustrative embodiment can be modified in arrangement and detail without departing from such principles. It should be understood that the programs, processes, or methods described herein are not related or limited to any particular type of computing environment, unless indicated otherwise. Various types of general purpose or specialized computing environments may be used with or perform operations in accordance with the teachings described herein. Elements of the illustrative embodiment shown in software may be implemented in hardware and vice versa.

In view of the many possible embodiments to which the principles of our invention may be applied, we claim as our invention all such embodiments as may come within the scope and spirit of the following claims and equivalents thereto.

We claim:

1. A computer-implemented method of decoding audio information, the method comprising:

receiving side information and frequency coefficient data in a transform domain;

performing an inverse time-split transform on adjacent frequency coefficients in the frequency coefficient data as indicated in the received side information, wherein the inverse time-split transform comprises an inverse of a selectively-applied sum and difference orthogonal transform performed on the adjacent frequency coefficients that changes time resolution for a portion of the frequency coefficient data; and performing an inverse transform on the received frequency coefficient data comprising transforming the coefficient data from the transform domain to a time domain.

2. The method of claim 1 further comprising:

identifying sub-frame sizes in the received side information;

wherein the inverse transform is performed according to the identified sub-frame sizes.

3. The method of claim 1 further comprising:

determining from the received side information whether there is a time-split in a sub-band.

4. The method of claim 1 further comprising:

determining from the received side information whether or not there is a time-split in each sub-band in an extended band.

5. The method of claim 1 further comprising:

prior to the performing the inverse time-split transform, performing the selectively-applied sum and difference orthogonal transform.

6. The method of claim 1 wherein the selectively-applied sum and difference orthogonal transform is performed in response to a detected changing signal characteristic.

7. The method of claim 6 wherein the adjacent frequency coefficients correspond to a location of the detected changing signal characteristic.

8. The method of claim 1 further comprising:

transforming coefficient data according to window and sub-band size information in the received side information.

9. The method of claim 1 wherein the adjacent frequency coefficients comprise at least one pair of adjacent coefficients in a vector X in the transform domain, where there are M coefficients in vector X that are uniquely identified as X[k] with k an integer ranging from 0 to M−1, so that the pair of adjacent coefficients is of the form {X[2r], X[2r+1]}, where r is an integer.

10. The method of claim 1 wherein the side information comprises information indicating whether or not there is a time-split in an extended band.

11. A computer-implemented method of processing audio information, the method comprising:

receiving an input audio information stream comprising audio coefficient data in a frequency domain and time-split information corresponding to at least a first portion of the audio coefficient data;

performing a time-split transform on adjacent frequency coefficients in the first portion of the audio coefficient data based at least in part on the time-split information, wherein the time-split transform comprises a selectively applied sum and difference orthogonal transform that changes time resolution for the first portion of the audio coefficient data; and performing an inverse of the time-split transform on the first portion of the audio coefficient data.

12. The method of claim 11 further comprising:

transforming the audio coefficient data from the frequency domain to a time domain.

13. The method of claim 11 wherein the time-split information comprises a signal in the input audio information stream that instructs a decoder to perform time-split transform processing.

14. The method of claim 13 wherein the signal is a single bit.

15. A computer-implemented method of processing audio information, the method comprising:

receiving an input audio information stream comprising audio coefficient data in a frequency domain corresponding to at least a first portion of audio coefficient data comprising plural frequency bands;

performing a time-split transform on adjacent frequency coefficients in a first frequency band in the first portion of the audio coefficient data, wherein the time-split transform comprises a selectively-applied sum and difference orthogonal transform that changes time resolution for the first frequency band in the first portion of the audio coefficient data while leaving time resolution unchanged for one or more other frequency bands; and performing an inverse of the time-split transform on the first portion of the audio coefficient data.

16. The method of claim 15 wherein the selectively-applied sum and difference orthogonal transform is performed in response to a detected changing signal characteristic.

17. The method of claim 15 wherein the adjacent frequency coefficients correspond to a location of a detected changing signal characteristic.

18. The method of claim 15 further comprising:

transforming the audio coefficient data from the frequency domain to a time domain.

19. The method of claim 15 wherein the performing the time-split transform on adjacent frequency coefficients is responsive to a signal in the input audio information stream that instructs a decoder to perform time-split transform processing.

20. The method of claim 19 wherein the signal is a single bit.

* * * * *